US011839779B2

(12) United States Patent
Nam

(10) Patent No.: US 11,839,779 B2
(45) Date of Patent: Dec. 12, 2023

(54) FIRE EVACUATION ROOM

(71) Applicant: E&F TECH CO., LTD., Hwaseong (KR)

(72) Inventor: Jung Oh Nam, Yongin (KR)

(73) Assignee: E&F TECH CO., LTD., Hwaseong (KR)

( * ) Notice: Subject to any disclaimer, the term of this patent is extended or adjusted under 35 U.S.C. 154(b) by 703 days.

(21) Appl. No.: 16/956,461

(22) PCT Filed: Dec. 7, 2018

(86) PCT No.: PCT/KR2018/015494
§ 371 (c)(1),
(2) Date: Jun. 19, 2020

(87) PCT Pub. No.: WO2019/124838
PCT Pub. Date: Jun. 27, 2019

(65) Prior Publication Data

US 2021/0113864 A1 Apr. 22, 2021

(30) Foreign Application Priority Data

Dec. 21, 2017 (KR) ..... 10-2017-0177137
Jul. 23, 2018 (KR) ..... 10-2018-0085253
Jul. 23, 2018 (KR) ..... 10-2018-0102052

(51) Int. Cl.
*A62B 13/00* (2006.01)
*F24F 7/08* (2006.01)
*A62B 31/00* (2006.01)

(52) U.S. Cl.
CPC ..... *A62B 31/00* (2013.01); *A62B 13/00* (2013.01); *F24F 7/08* (2013.01); *F24F 2221/125* (2013.01)

(58) Field of Classification Search
CPC ..... A62B 31/00; A62B 13/00; A62B 11/00; A62B 5/00; E04H 1/1261; E04H 9/14;
(Continued)

(56) References Cited

U.S. PATENT DOCUMENTS 2,957,402 A * 10/1960 Miller ..... A62B 13/00 454/263
3,138,124 A * 6/1964 Baier ..... E04H 9/12 109/1 S
(Continued)

FOREIGN PATENT DOCUMENTS

CN 105003997 A * 10/2015 ..... F24F 11/0001
GB 2535203 A * 8/2016 ..... E04B 1/34321
(Continued)

OTHER PUBLICATIONS

Jung Nam, KR 101578929 Nam Espacenet Machine Translation, Dec. 21, 2015 (Year: 2015).*
(Continued)

*Primary Examiner* — Edelmira Bosques
*Assistant Examiner* — Frances F. Hamilton

(57) ABSTRACT

A fire evacuation room includes a main body having an entrance and an evacuation space, a door installed in the entrance, an air intake pipe connected to a rear portion of a ceiling of the main body to induce air entering the evacuation space, an air discharge pipe connected to a front portion of the ceiling to induce air exiting the evacuation space, an air discharge fan installed on an inner rear wall of the main body while facing the entrance and turned ON/OFF in conjunction with an opening/closing of the door, a lamp installed on the ceiling, a control box installed inside the main body, a sub-air intake pipe branching from one side of the air intake pipe, and an oxygen generator connected to the sub-air intake pipe and configured to receive the air and
(Continued)

generate oxygen, the oxygen being supplied into the main body.

23 Claims, 9 Drawing Sheets

(58) Field of Classification Search
CPC ..... E04H 9/00; F24F 2221/125; F24F 7/08; F24F 2221/124
USPC ..... 454/253
See application file for complete search history.

(56) References Cited

U.S. PATENT DOCUMENTS 3,191,517 A * 6/1965 Solzman ..... A62B 13/00 454/902
4,068,568 A * 1/1978 Moss ..... A62C 99/00 454/238
4,663,885 A * 5/1987 Stibolt ..... E06B 9/04 49/504
6,385,920 B1 * 5/2002 Chandler ..... E04H 9/12 52/169.7
9,784,466 B2 * 10/2017 Kim ..... F24F 11/30
10,597,895 B1 * 3/2020 Daniels ..... C12M 43/00
2002/0023762 A1 * 2/2002 Kotliar ..... B01D 53/22 62/640
2007/0033882 A1 * 2/2007 Bessent ..... E04H 1/125 52/79.1
2013/0032310 A1 * 2/2013 Jaena ..... H05K 7/1497 165/138
2013/0205691 A1 * 8/2013 Shalev ..... F28F 1/00 52/741.12
2016/0348386 A1 * 12/2016 Beckmann ..... F16K 17/02

FOREIGN PATENT DOCUMENTS

KR 1020080050552 A 6/2008
KR 1020100128779 A 12/2010
KR 101286886 B1 * 7/2013 ..... A62B 13/00
KR 101578929 B1 * 12/2015 ..... A62B 15/00
KR 101578929 B1 12/2015
KR 101607895 B1 4/2016
KR 101732069 B1 * 3/2017 ..... A62B 13/00
KR 101738823 B1 5/2017

OTHER PUBLICATIONS

Jung Nam, KR 101607895B1 Nam Espacenet Machine Translation, Apr. 1, 2016 (Year: 2016).*
Search Report dated Mar. 21, 2019 for PCT Application No. PCT/KR2018/015494.

* cited by examiner

FIRE EVACUATION ROOM

TECHNICAL FIELD

The present invention relates to a fire evacuation room, and more specifically to a fire evacuation room that provides a space installed indoors in a high-rise building such as an apartment block so as to provide a person who is unable to escape outside with a space to safely take refuge.

BACKGROUND ART

As our living space is gradually urbanized, the residential space is tending to be high-rise, however, despite the developed residential environment, it is still a reality to feel anxious in the event of a fire.

Especially, when fire occurs at night during sleepiness, it is inevitable to evacuate to other areas.

In addition, in the case of persons having mobility difficulties, such as patients, pregnant women, children, and the disabled, it is not easy to evacuate to a safe zone when they are alone or even if there are guardians.

In the case of a high-rise building where many people live and work within a limited space, installation of emergency exits and fire doors is mandatory because of the risk of fatal injury in the event of a fire and various evacuation facilities such as descenders are installed.

However, typically, when a fire occurs in a high-rise building, there are very few people who know how to use the descender, so that evacuation through the descender is rarely achieved. In addition, the emergency exit may be filled with smoke because the emergency exit may play a role of chimney, so it is also difficult to evacuate through the emergency exit.

In view of the above, in recent years, a lot of fire evacuation rooms have been installed at balconies of apartments or row houses or inside high-rise buildings to allow persons who could not evacuate in the event of a fire to stay until the arrival of firefighters.

In general, the fire evacuation room is installed at the balcony of the apartment or inside the high-rise building, and includes an evacuation room in which all circumferences and upper and lower sides of the evacuation room are blocked, a fire door provided on an interior wall of the evacuation room to allow people to enter, and an exit door provided on the outside wall of the evacuation room so that people stayed in the evacuation room can escape to the ground through a ladder car.

As an example, Korean Patent Registration No. 10-1578929 discloses a 'fire evacuation room for basement'.

The above 'fire evacuation room for basement' includes a body installed on a floor of the basement, a hinge-type fire door for allowing people to enter and exit, an air intake pipe drawing out to the ground by passing through an upper wall of the body, and an air discharge pipe drawing out to the ground by passing through the upper wall of the body. When a person cannot escape upon a fire, the fire evacuation room functions to allow the person to temporarily and safely stay.

The present invention has been suggested to provide a 'fire evacuation room' which can enhance the safety and functionality by improving the configuration and function of the 'fire evacuation room basement'.

RELATED DOCUMENTS

Korean Patent Registration No. 10-1578929

Korean Unexamined Patent Publication No. 10-2010-128779

Korean Patent Registration No. 10-1395180

Korean Patent Registration No. 10-1738823

Korean Patent Registration No. 10-1607895

DISCLOSURE

Technical Problem

Accordingly, the present invention has been made to solve the above problems and an object of the present invention is to provide a fire evacuation room, which is installed indoors in an apartment or in a basement of a building as desired so as to enable a person unable to evacuate outside the building to safely evacuate.

In addition, another object of the present invention is to provide a fire evacuation room, in which a predetermined differential pressure is constantly produced in an evacuation space by suitably controlling the amount of air entering the evacuation space and the amount of air leaving the evacuation space, thereby compensating for the occurrence of leaks inside the evacuation space caused by damage due to falling objects and the like, and completely eliminating a shortage of air for breathing.

In addition, still another object of the present invention is to provide a fire evacuation room that can improve the overall operation efficiency of the system for air supply by collectively managing the air supply for each fire evacuation room in a building by connecting each air intake pipe of each fire evacuation room installed on each story of the building to pipes of ventilation equipment of the building or to separate pipes of blower equipment installed inside the building.

Further, still another object of the present invention is to provide a fire evacuation room, in which a compulsive air discharge fan is installed in the interior wall surface inside an evacuation space and operated in association with opening and closing operation of a door so as to compulsively discharge air inside the evacuation space when the door is open and consequently, the evacuation space is able to block the entry of smoke or heat to the inside from the outside.

In addition, still another object of the present invention is to provide a fire evacuation room, in which a branch pipe is formed on one side of an air intake pipe through which external air flows into an evacuation room main body, and a filter device capable of purifying toxic gas such as smoke is installed on the branch pipe together with an oxygen generator that generates oxygen so as to block the entry of external toxic gas while simultaneously supplying air to the inside of the evacuation room main body to allow evacuees to breathe, or an air storage tank utilizing a frame space of the evacuation room main body is used so as to implement a new system that blocks external toxic gas and supplies air into the inside of the evacuation room main body to allow the evacuees to breathe, thereby completely eliminating the problems caused by the toxic gas flowing into the fire evacuation room and safely protecting the evacuees as much as possible.

Technical Solution

In order to achieve the above objects, the fire evacuation room provided in the present invention has the following features.

A fire evacuation room according to a first embodiment of the present invention includes: an evacuation room main body installed inside a building and having an entrance at a front thereof and an evacuation space at an inside thereof, and an openable door installed in the entrance of the evacuation body main body; an air intake pipe connected to a rear portion of a ceiling of the evacuation room main body to induce air entering the evacuation space; an air discharge pipe connected to a front portion of the ceiling of the evacuation room main body to induce air exiting the evacuation space; a compulsive air discharge fan installed on an inner rear wall of the evacuation room main body while facing the entrance, and turned ON/OFF in conjunction with an opening/closing operation of a door to block external smoke or heat from entering the evacuation space when the door is opened; a lamp installed on the ceiling inside the evacuation room main body; and a control box installed inside the evacuation room main body to supply power and to control electric appliances.

The air intake pipe may have a diameter relatively larger than a diameter of the air discharge pipe, so that an amount of air entering the evacuation space is greater than an amount of air exiting the evacuation space, thereby forming a constant differential pressure in the evacuation space.

In addition, upper and lower walls, left and right walls, and a rear wall of the evacuation room main body and a plate member of the door may be configured as a double panel structure including inner panels and outer panels that define a gap therebetween, and a bulletproof plate woven from Kevlar fiber may be attached to each inner panel.

Four wheels including front and rear wheels and left and right wheels and a stopper may be installed on a bottom surface of the evacuation room main body as a means for moving and fixing and an air conditioner may be installed on an inner rear wall of the evacuation room main body to cool air inside the evacuation space upon malfunction of an air intake and discharge system.

The evacuation room main body may be installed on each floor of a high-rise building, and the air intake pipe of each evacuation room main body installed on each floor may be connected to a pipe of a ventilation system of the building or a pipe of a blower separately installed in the building, so that air supply to each evacuation room main body may be collectively managed in an area inside the building.

A wall heat shield member, which is configured as a band-shaped member having a section of a "⊐" shape, has a silica rope inserted into a groove of the section and minimize thermal conductivity through a joint portion between walls of the evacuation room main body, may be fitted into the joint portion between walls of the evacuation room main body.

The door may include a door heat shield member having a nine-step bent section, which may be installed along edges of four sides of the door to minimize thermal conductivity through the door.

Meanwhile, a fire evacuation room according to a second embodiment of the present invention includes: an evacuation room main body installed inside a building and having an entrance at a front thereof and an evacuation space at an inside thereof, and an openable door installed in the entrance of the evacuation body main body; an air intake pipe connected to a rear portion of a ceiling of the evacuation room main body to induce air entering the evacuation space; an air discharge pipe connected to a front portion of the ceiling of the evacuation room main body to induce air exiting the evacuation space; a compulsive air discharge fan installed on an inner rear wall of the evacuation room main body while facing the entrance, and turned ON/OFF in conjunction with an opening/closing operation of a door to block external smoke or heat from entering the evacuation space when the door is opened; a control box installed inside the evacuation room main body to supply power and to control electric appliances; and an air supply device for breathing, which includes a sub-air intake pipe branching from one side of the air intake pipe, first and second solenoid valves installed on the air intake pipe and the sub-air intake pipe, respectively, a filter device installed on the sub-air intake pipe to purify toxic gas in the air, and an oxygen generator connected to the sub-air intake pipe to receive the air and to generate oxygen, wherein the first solenoid valve is turned OFF and the second solenoid valve is turned ON under an output control of the control box receiving a signal of a sensor installed at a side of the air intake pipe, and the oxygen generator is operated so that the oxygen supplied from the oxygen generator is supplied into an inside of the evacuation room main body.

The sub-air intake pipe, the second solenoid valve, the filter device, and the oxygen generator may be installed in a space portion defined inside the walls of the evacuation room main body.

In addition, the air intake pipe may have a diameter relatively larger than a diameter of the air discharge pipe, so that an amount of air entering the evacuation space may be greater than an amount of air exiting the evacuation space, thereby forming a constant differential pressure in the evacuation space.

According to a preferred embodiment, upper and lower walls, left and right walls, and a rear wall of the evacuation room main body and a plate member of the door may be configured as a double panel structure including inner panels and outer panels that define a gap therebetween, and a bulletproof plate woven from Kevlar fiber may be attached to each inner panel.

According to a preferred embodiment, an air conditioner may be installed on an inner rear wall of the evacuation room main body to cool air inside the evacuation space upon malfunction of an air intake and discharge system.

According to a preferred embodiment, the evacuation room main body may be installed on each floor of a high-rise building, and the air intake pipe of each evacuation room main body installed on each floor may be connected to a pipe of a ventilation system of the building or a pipe of a blower separately installed in the building, so that air supply to each evacuation room main body may be collectively managed in an area inside the building.

According to a preferred embodiment, a wall heat shield member, which is configured as a band-shaped member having a section of a "⊐" shape, has a silica rope inserted into a groove of the section and minimizes thermal conductivity through a joint portion between walls of the evacuation room main body, may be fitted into the joint portion between walls of the evacuation room main body.

According to a preferred embodiment, the door may include a door heat shield member having a nine-step bent section, which is installed along edges of four sides of the door to minimize thermal conductivity through the door.

Meanwhile, a fire evacuation room according to a third embodiment of the present invention includes: an evacuation room main body installed inside a building and having an entrance at a front thereof and an evacuation space at an inside thereof, and an openable door installed in the entrance of the evacuation body main body; an air intake pipe connected to a rear portion of a ceiling of the evacuation room main body to induce air entering the evacuation space; an air discharge pipe connected to a front portion of the ceiling of the evacuation room main body to induce air exiting the evacuation space; a compulsive air discharge fan installed on an inner rear wall of the evacuation room main body while facing the entrance, and turned ON/OFF in conjunction with an opening/closing operation of a door to block external smoke or heat from entering the evacuation space when the door is opened; a control box installed inside the evacuation room main body to supply power and to control electric appliances; and an air supply device for breathing, which includes a first solenoid valve installed on the air intake pipe, an air storage tank installed at an internal space of a bottom member of the evacuation room main body, a pump installed at a discharge port of the air storage tank and a third solenoid valve, wherein the first solenoid valve is turned OFF and the third solenoid valve is turned ON under an output control of the control box receiving a signal of a sensor installed on a side of the air intake pipe, and the pump is operated so that the air filled in the air storage tank is supplied into an inside of the evacuation room main body.

The air intake pipe may have a diameter relatively larger than a diameter of the air discharge pipe, so that an amount of air entering the evacuation space may be greater than an amount of air exiting the evacuation space, thereby forming a constant differential pressure in the evacuation space.

In addition, upper and lower walls, left and right walls, and a rear wall of the evacuation room main body and a plate member of the door may be configured as a double panel structure including inner panels and outer panels that define a gap therebetween, and a bulletproof plate woven from Kevlar fiber may be attached to each inner panel.

Further, an air conditioner may be installed on an inner rear wall of the evacuation room main body to cool air inside the evacuation space upon malfunction of an air intake and discharge system.

According to a preferred embodiment, the evacuation room main body may be installed on each floor of a high-rise building, and the air intake pipe of each evacuation room main body installed on each floor may be connected to a pipe of a ventilation system of the building or a pipe of a blower separately installed in the building, so that air supply to each evacuation room main body may be collectively managed in an area inside the building.

According to a preferred embodiment, a wall heat shield member, which is configured as a band-shaped member having a section of a "E" shape, has a silica rope inserted into a groove of the section and minimizes thermal conductivity through a joint portion between walls of the evacuation room main body, may be fitted into the joint portion between walls of the evacuation room main body.

According to a preferred embodiment, the door may include a door heat shield member having a nine-step bent section, which is installed along edges of four sides of the door to minimize thermal conductivity through the door.

Advantageous Effects

The fire evacuation room provided in the present invention has the following effects.

First, it can be freely installed in the interior or basement of a building so that those who cannot evacuate outside the building in the event of a fire can be safely stayed until rescue personnel arrive.

Second, a predetermined differential pressure can be constantly produced in an evacuation space by suitably and automatically controlling the amount of air entering the evacuation space and the amount of air leaving the evacuation space based on the difference in size (diameter) between an air intake pipe and an air discharge pipe of the fire evacuation room, thereby compensating for the occurrence of leaks inside the evacuation space caused by damage due to falling objects and the like, and completely eliminating a shortage of air for breathing so that the safety in the evacuation space can be ensured.

Third, it is possible to improve the overall operation efficiency of the system for air supply by collectively managing the air supply for each fire evacuation room by connecting each air intake pipe of each fire evacuation room installed on each story of the building to pipes of ventilation equipment installed in the building or to pipes of blower equipment separately installed in the building, and it can be suitably applied to a building where the air supply or air discharge is impossible or a building having a structure where it is difficult to draw the air intake pipe out of the building.

Fourth, a compulsive air discharge fan operated in association with opening and closing operation of a door can be installed in the interior wall surface inside the evacuation space of the fire evacuation room, for example, in the wall surface facing a front of an entrance. Thus, when the door is open for evacuation upon fire, the compulsive air discharge fan is operated to compulsively discharge air inside the evacuation space toward the entrance, thereby allowing the evacuation space to completely block the entry of smoke or heat to the inside from the outside.

Fifth, air conditioning equipment is provided inside the evacuation space in the fire evacuation room, so the air inside the evacuation space can be prevented from being heated even when there is an abnormality in the air supply and discharge system, thereby enhancing the safety.

Sixth, a branch pipe is formed on one side of an air intake pipe through which external air flows into an evacuation room main body, and a filter device capable of purifying toxic gas such as smoke is installed on the branch pipe together with an oxygen generator that generates oxygen so as to block the entry of external toxic gas while simultaneously supplying air to the inside of the evacuation room main body to allow evacuees to breathe, or an air storage tank utilizing a frame space of the evacuation room main body is used so as to implement a new system that blocks external toxic gas and supplies air into the inside of the evacuation room main body to allow the evacuees to breathe, thereby completely eliminating the problems caused by the toxic gas flowing into the fire evacuation room and safely protecting the evacuees as much as possible.

BEST MODE

Mode for Invention

Hereinafter, the present invention will be described in detail with reference to the accompanying drawings.

Figure 1:
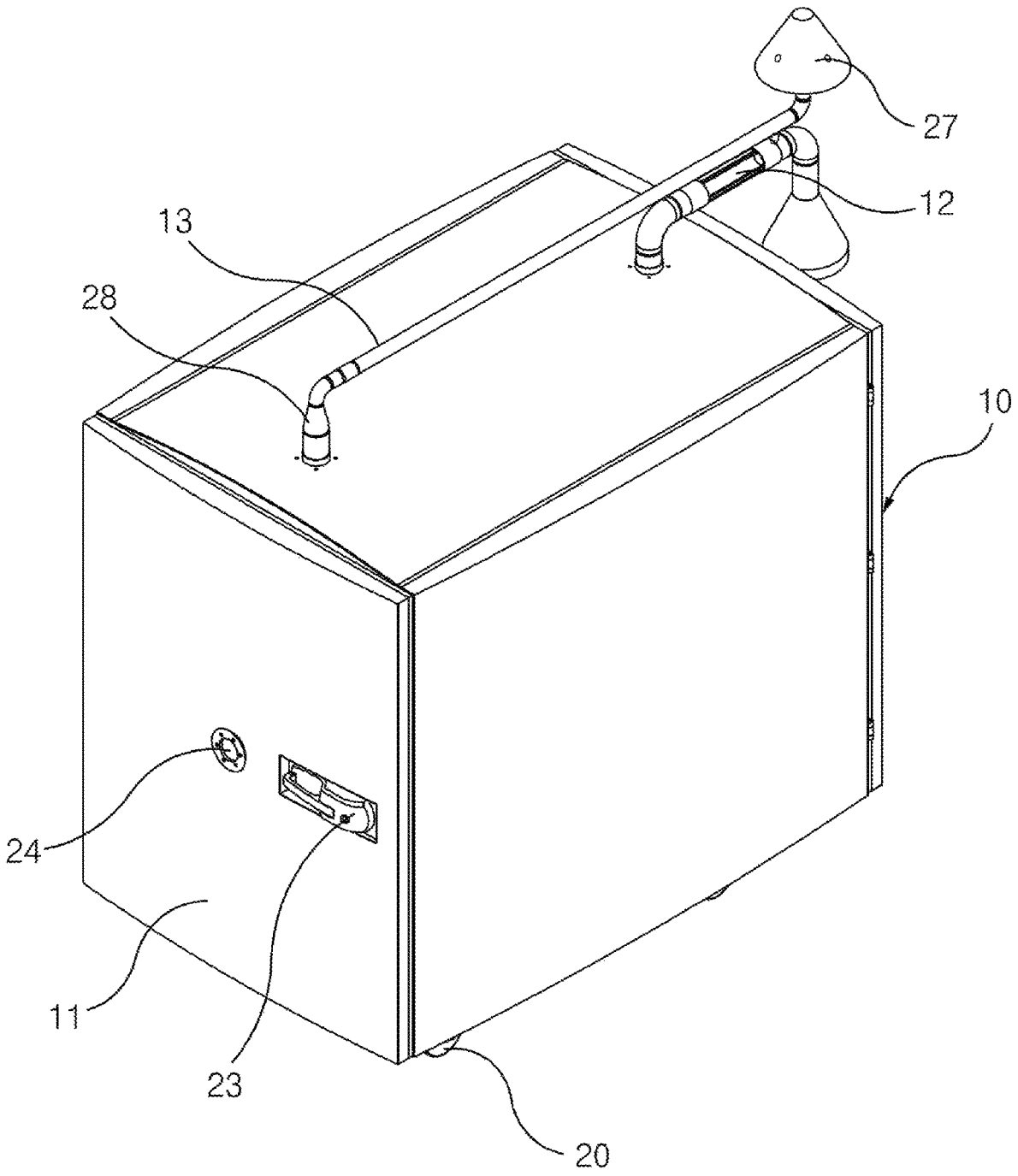
FIGS. 1 to 3 are perspective views showing a fire evacuation room according to a first embodiment of the present invention.
Figure 2:
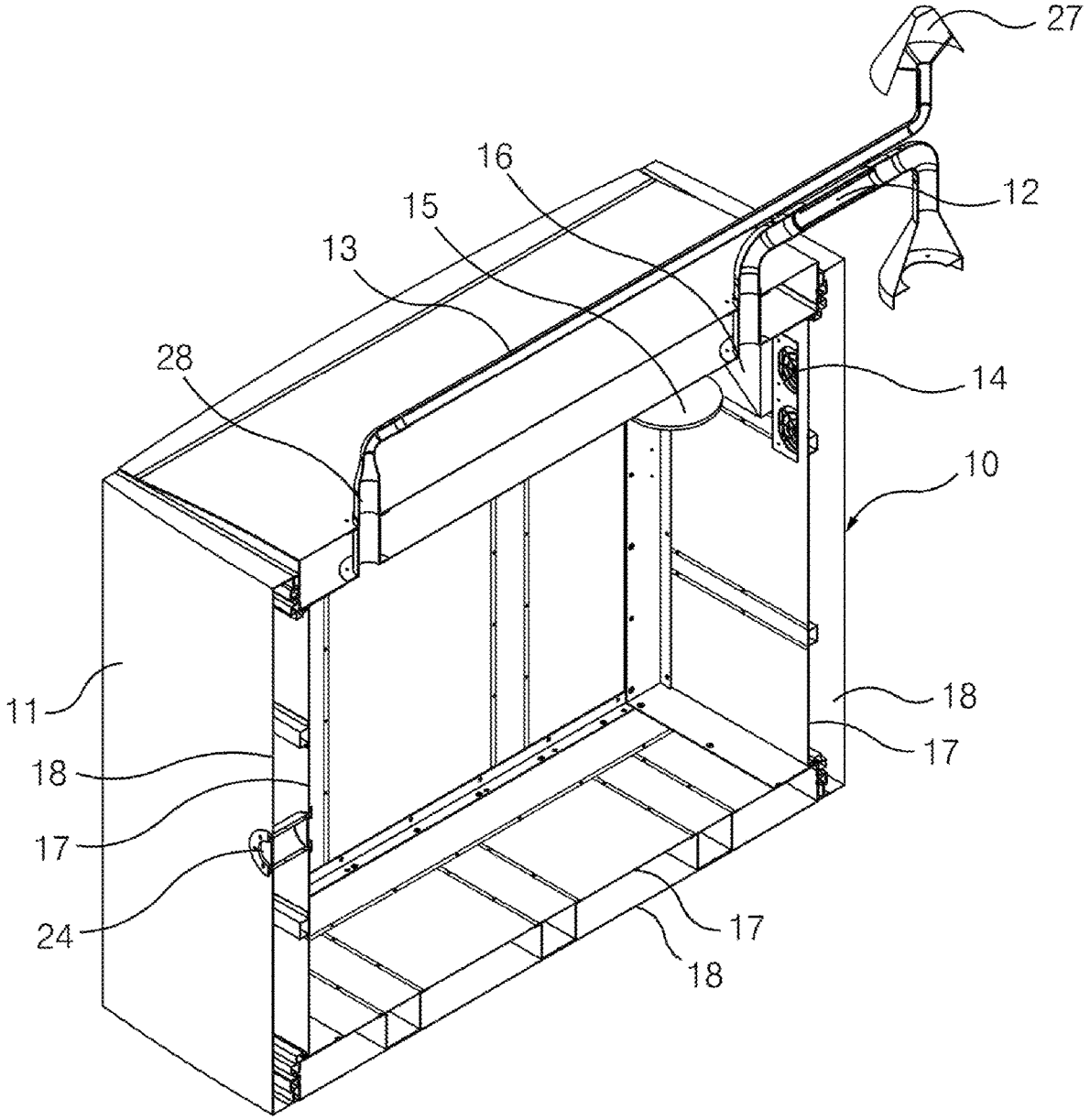
Figure 3:
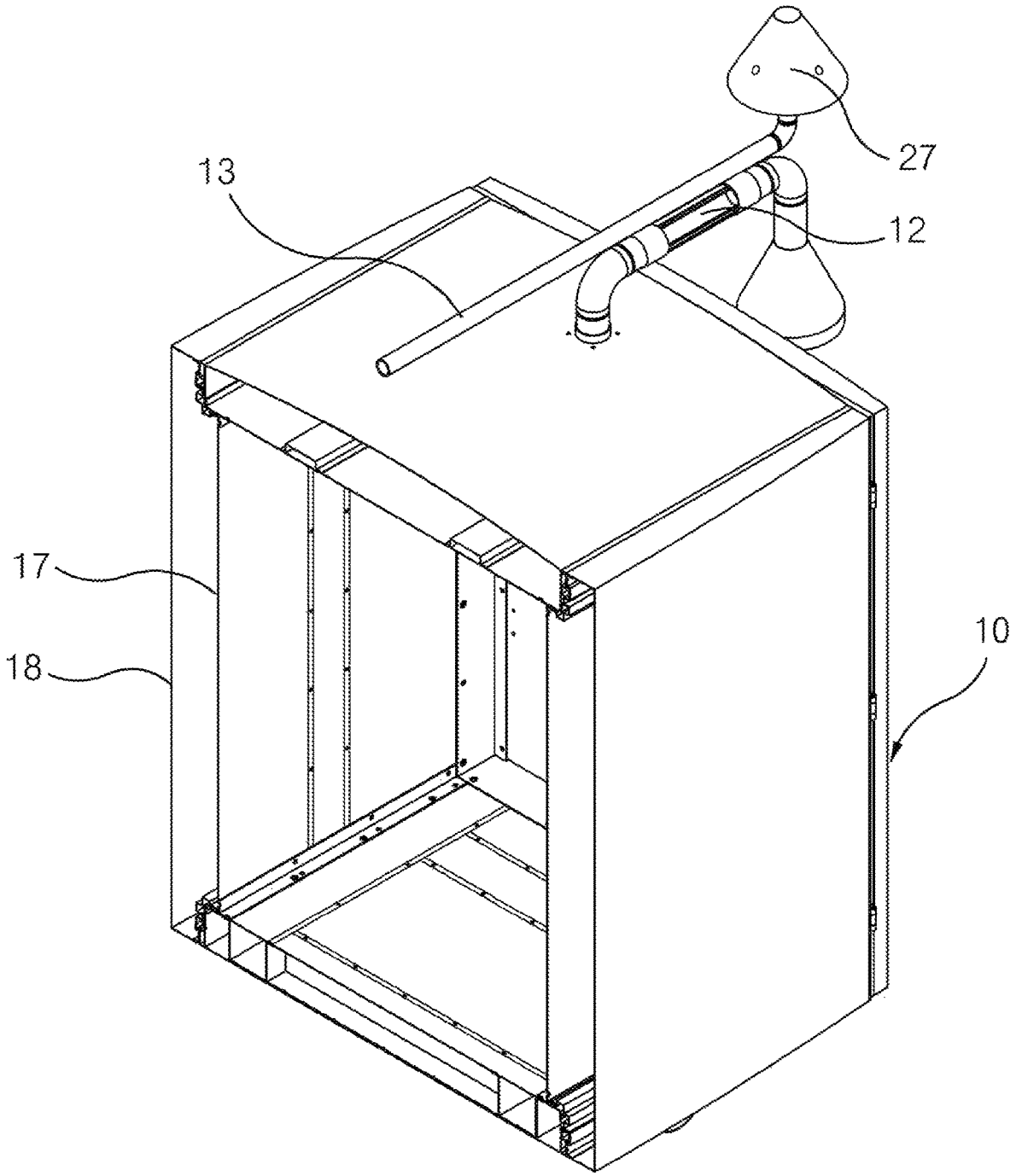
Figure 4:
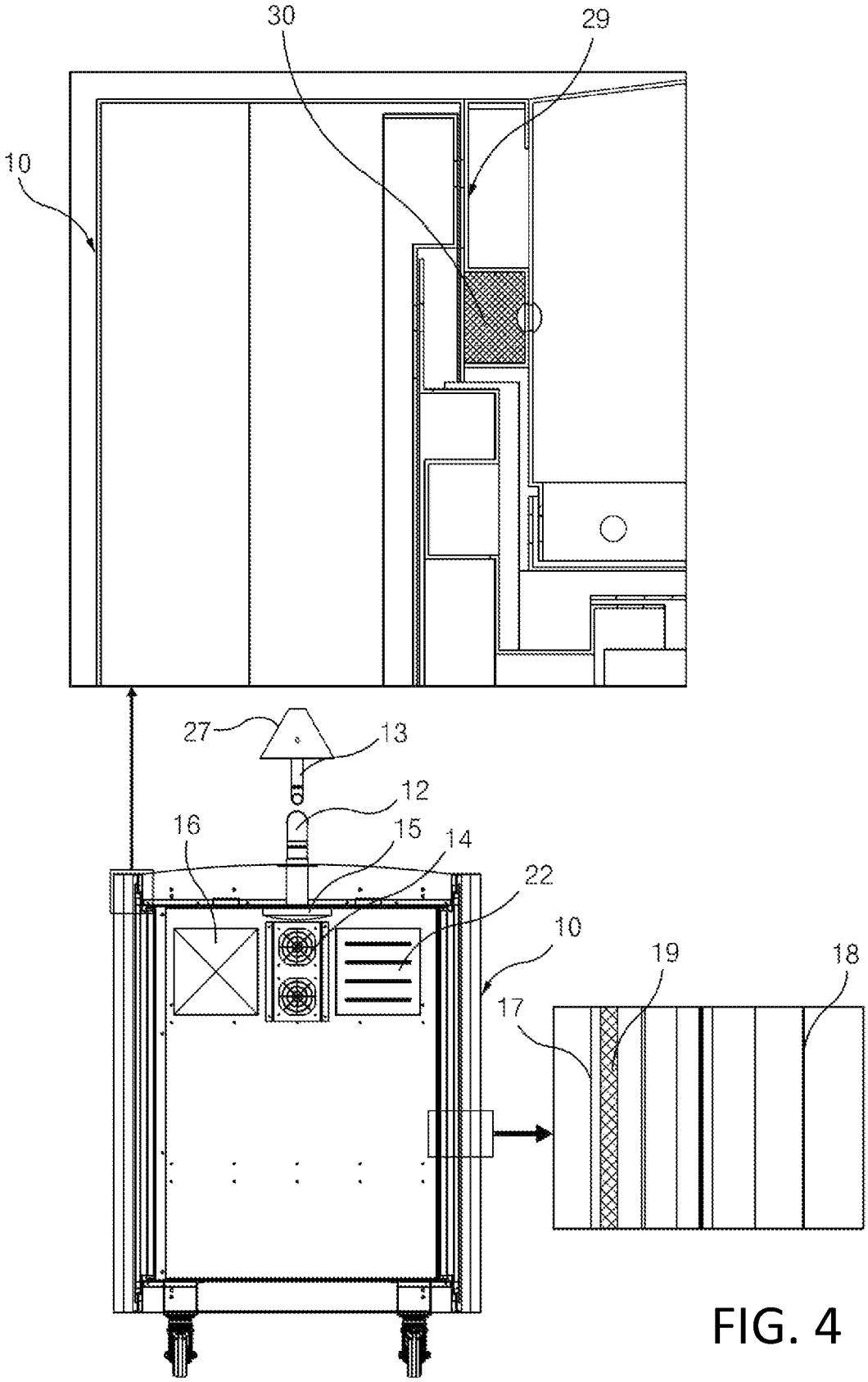
FIGS. 4 to 6 are sectional views showing the fire evacuation room according to the first embodiment of the present invention.
Figure 5:
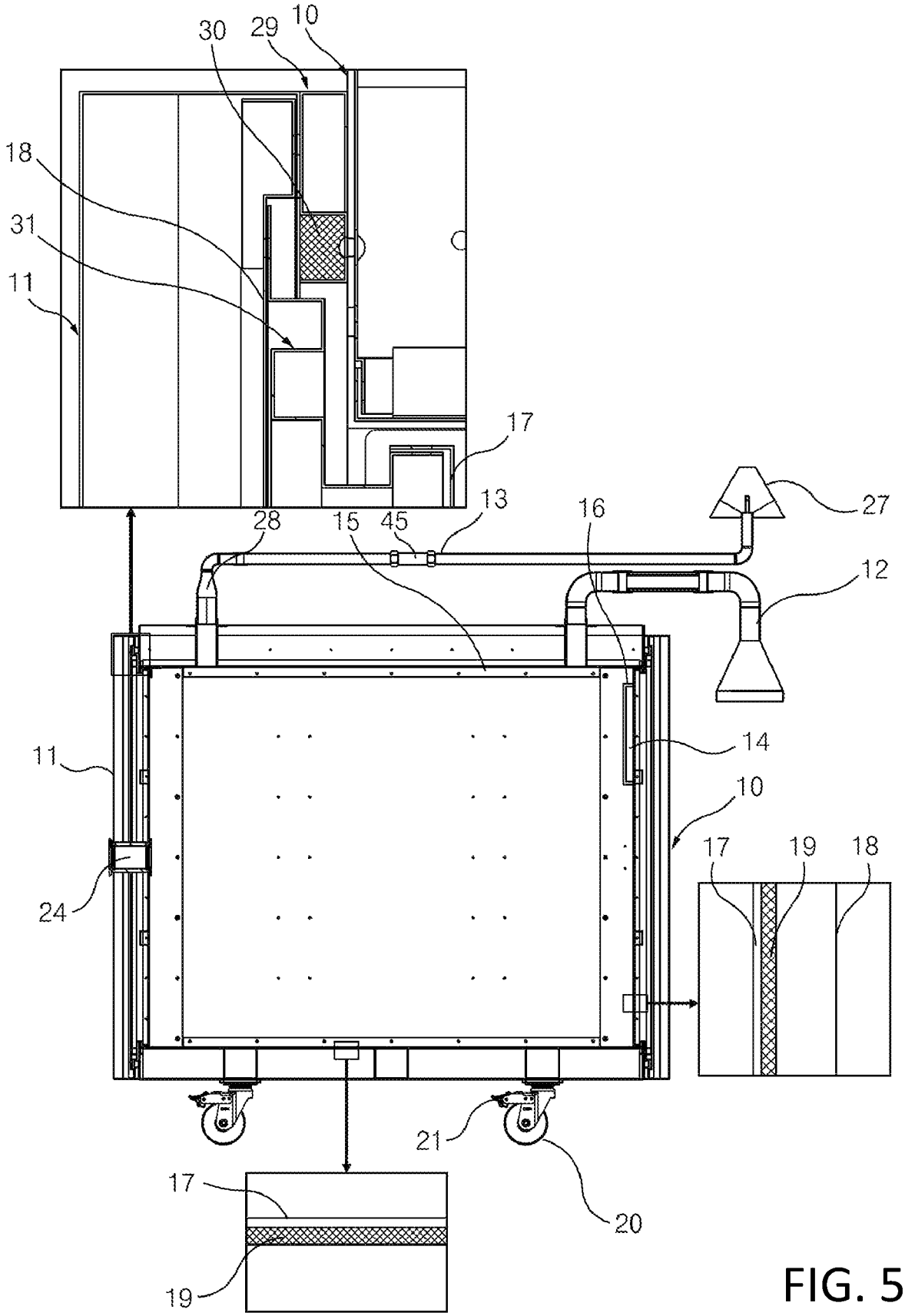
Figure 6:
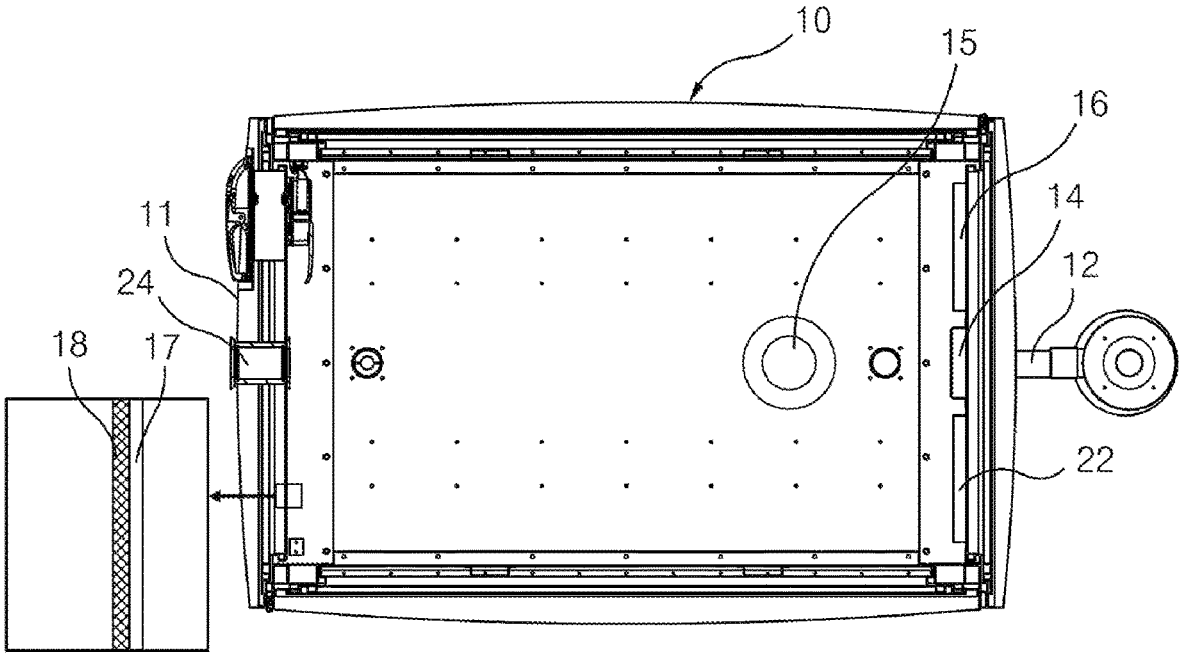

FIGS. 1 to 3 are perspective views showing a fire evacuation room according to a first embodiment of the present invention, and FIGS. 4 to 6 are sectional views showing the fire evacuation room according to the first embodiment of the present invention.

As shown in FIGS. 1 to 6, the fire evacuation room may have an evacuation room main body 10 installed inside a building and having an entrance formed at a front thereof and an evacuation space formed therein, and an openable door 11 installed in the entrance of the evacuation room main body 10.

The evacuation room main body 10 may have a rectangular box-like structure having an evacuation space where a large number of persons can be stayed for evacuation, and the entrance, which is formed at the front of the evacuation room main body 10 for access of persons, may be opened.

For example, the evacuation room main body 10 may have the rectangular box-like structure including upper and lower walls, left and right walls, and a rear wall, and a front portion thereof corresponding to the entrance may be opened.

Each of the walls of the evacuation room main body 10 may have a double panel structure including an inner panel 17 and an outer panel 18, which are formed of a metal material and define a gap therebetween. Thus, the evacuation room main body 10 may have the structural rigidity and heat insulation property.

In this case, a plurality of "ㄷ"-shaped or rectangular tube-shaped reinforcing members may be interposed between the inner and outer panels 17 and 18, so that the inner and outer panels 17 and 18 may be fastened to each other, thereby maintaining the overall structural rigidity of the walls.

In addition, a wall heat shield member 29 having a predetermined bent shape may be inserted into a joint portion between the walls of the evacuation room main body 10.

The wall heat shield member 29 may be formed of a band-shaped member having a substantially "ㄹ" shaped section, arranged in parallel to the joint portion between the walls, and fixed to the walls by a rivet fastening structure or welding, etc.

In addition, a silica rope 30 may be inserted into a groove formed in a section of the wall heat shield member 29, and the silica rope 30 may serve to effectively block heat transmitted through the walls.

Accordingly, when heat is transferred to the evacuation room main body 10 in the event of a fire, most of the heat may be blocked by the thick wall. In addition, the heat transferred through the joint portion between the walls may also be completely blocked due to the extension of the heat transfer path by the bent shape of wall heat shield member 29, the minimization of the thermal conductivity by the reduction of a thermal contact section, and the thermal barrier action by the silica rope 30

In particular, a bulletproof plate 19 woven from Kevlar fibers may be attached to an inside of the inner panel 17 and the outer panel 18 constituting each wall of the evacuation room main body 10, that is, an inner surface of the inner panel 17, thereby effectively preventing debris generated upon explosion in the event of a fire from penetrating into the evacuation space through the wall. Thus, it is possible not only to prevent human injury, but also to prevent the internal air from leaking by preventing the evacuation room main body 10 from being damaged or broken.

In addition, four wheels 20 including front and rear wheels and left and right wheels and a well-known stopper 21 may be installed on the bottom surface of the evacuation room main body 10, so that the user may easily move the evacuation room main body 10 and may easily install the evacuation room main body 10 in a desired place.

The door 11 may be a hinge-type fire door installed at the entrance of the evacuation room main body 10 and may be opened and closed in the entrance installed at the front of the evacuation room main body 10 by using a hinge part (not shown) formed at one side of the door 11.

Further, the door 11 may be opened or closed by manipulating a well-known opening and closing handle 22, which is installed at one side of a front surface of the door 11 and has a lock/unlock function. In the closed state of the door 11, the circumference of the entrance of the evacuation room main body 10 may be maintained in a completely closed state.

A door panel of the door 11 may have a double panel structure including the inner panel 17 and the outer panel 18, which are formed of a metal material and define a gap therebetween. Thus, the door 11 may have the structural rigidity and heat insulation property. In this case, a plurality of "ㄷ"-shaped or rectangular tube-shaped reinforcing members may be interposed between the inner and outer panels 17 and 18, so that the inner and outer panels 17 and 18 may be fastened to each other, thereby maintaining the overall structural rigidity of the panel.

The bulletproof plate 19 woven from Kevlar fibers may be attached to an inside of the inner panel 17 and the outer panel 18 constituting the door panel of the door 11, that is, an inner surface of the inner panel 17, thereby effectively preventing debris generated upon explosion in the event of a fire from penetrating into the evacuation space through the panel. Thus, it is possible not only to prevent human injury, but also to prevent the internal air from leaking by preventing the evacuation room main body 10 from being damaged or broken.

In addition, the door 11 is provided with a confirmation window 23 formed through the inner and outer panels 17 and 18. Thus, persons inside the evacuation room main body 10 and rescue personnel outside the evacuation room main body 10 may check the status of each other.

In particular, the door 11 may be provided with a door heat shield member 31 having a nine-step bent section, so that the thermal conductivity through the door 11 may be reduced as much as possible.

The door heat shield member 21 may be arranged along edges of four sides between the inner panel 17 and the outer panel 18 and fastened to the panel by a rivet fastening structure or welding.

Accordingly, when heat is transferred to the door 11 in the event of a fire, the heat may be transferred through the nine-step bent section of the door heat shield member 31, that is, through a long heat transfer path, so that the thermal conductivity may be minimized, and thus, the thermal conduction through the door 11 may be completely blocked.

In addition, the fire evacuation room may include an air intake pipe 12 connected to a rear portion of a ceiling of the evacuation room main body 10 to serve as a passage for air entering the evacuation space and an air discharge pipe 13 connected to a front portion of the ceiling of the evacuation room main body 10 to serve as a passage for air exiting the evacuation space.

The air intake pipe 12 may be a tube formed of a metal pipe or the like, and communicate with a rear evacuation space by passing through the inner panel 17 and the outer panel 18 of an upper wall of the evacuation room main body 10. The air intake pipe 12 having the above configuration may extend rearward of the evacuation room main body 10 by a predetermined length.

In addition, a rear end portion of the air intake pipe 12 having the above configuration may be connected to a pipe 25 of a ventilation system of the building or a pipe 25 of a blower separately installed in the building to receive air, which will be described below.

According to another embodiment, when the air intake pipe 12 has a structure capable of solely inhaling air without being connected to the pipe 25 of the ventilation system of the building or the pipe 25 of the blower of the building, an air intake fan 43 may be installed at an outer end of the air intake pipe 12. Accordingly, when the air intake fan 43 is operated, external air may be is introduced through the air intake pipe 12 and supplied to the evacuation room main body 10.

The air intake pipe 12 may have a double-pipe structure so that it is possible to prevent the air flowing into the evacuation space formed inside the evacuation room main body 10 through the air intake pipe 12 from being heated, thereby completely solving the problem such as the difficulty in breathing of the evacuee caused by the heated air.

The air discharge pipe 13 may be a tube formed of a metal pipe or the like, and communicate with a front evacuation space by passing through the inner panel 17 and the outer panel 18 of the upper wall of the evacuation room main body 10. The air intake pipe 12 having the above configuration may extend rearward of the evacuation room main body 10 by a predetermined length.

A rear end portion of the air discharge pipe 13 having the above configuration may be exposed to the interior of the evacuation room (26 in FIG. 7) provided inside the building. Accordingly, the air discharged from the interior of the evacuation room main body 10 may be discharged to the evacuation room through the air discharge pipe 13.

The end portion of the air discharge pipe 13, that is, the end portion, which is bent upward, may be provided with a conical shade 27, and the conical shade 27 may prevent foreign substances such as dust from entering the interior of the air discharge pipe 13.

In particular, the internal evacuation space of the evacuation room main body 10 may be always maintained in an environment in which a constant differential pressure is created, so that a sufficient amount of air required for breathing may remain in the evacuation space.

To this end, a diameter of the air intake pipe 12 may be relatively larger than a diameter of the air discharge pipe 13.

In this case, a ratio of the diameter of the air discharge pipe 13 to the diameter of the air intake pipe 12 may be about 60%, for example, the diameter of the air intake pipe 12 may be about 50 mm, and the diameter of the discharge pipe 13 may be about 30 mm.

A connecting portion of the air discharge pipe 13 to the evacuation room main body 10 may have a diameter the same as the diameter of the air intake pipe 12, so that the air initially discharged from the interior of the evacuation room main body 10 may flow smoothly. In addition, since a tapered shaft pipe portion 28 is provided in the initial section of the air discharge pipe 13, the remaining section of the air discharge pipe 13 may have a relatively small diameter as compared with the air intake pipe 12.

Therefore, since the diameter of the air intake pipe 12 is relatively larger than the diameter of the air discharge pipe 13, the amount of air entering the evacuation space may be greater than the amount of air exiting the evacuation space, thereby always maintaining the constant differential pressure in the evacuation space.

As a result, even if a leak occurs due to the breakage of the evacuation room main body 10 caused by external impact such as falling objects, explosions, etc. in the event of a fire, it is possible to compensate for the leak. Therefore, the evacuees may breathe without a special problem due to the amount of air remaining in the evacuation room main body 10 so that the safety of evacuees may be ensured as much as possible.

Further, the external smoke, flame, contaminated air, etc. may be prevented from flowing back through the air discharge pipe 13 due to the differential pressure created in the evacuation space formed in the evacuation room main body 10 so that the safety of evacuees may be further secured.

In addition, a check valve 45 may be installed in the air discharge pipe 13, so that the air inside the evacuation room main body 10 may be discharged through the air discharge pipe 13, and external air, smoke, toxic gas, etc. may be prevented from flowing back to the interior of the evacuation room main body 10 through the air discharge pipe 13.

In addition, the fire evacuation room may include a compulsive air discharge fan 14 that prevents the external smoke or heat from entering the interior of the evacuation room main body 10 when the evacuee opens the door 11 to enter the interior of the evacuation room main body 10.

The compulsive air discharge fan 14 may be installed on the inner rear wall of the evacuation room main body 10 while facing the entrance, that is, a front of the door 11, and may be turned ON when the door 11 is opened and turned OFF when the door 11 is closed.

To this end, a well-known door detection sensor (not shown) may be installed on one side of the entrance of the evacuation room main body 10, and when the door detection sensor detects the opening of the door 11, the detection signal may be input into the control box 16, and at the same time, the compulsive air discharge fan 14 may be operated under the output control of the control box 16, that is, the door 11 may be opened, and at the same time, strong wind may blow outward from the interior of the evacuation room main body 10, so that it is possible to completely block the external smoke or heat from entering the evacuation space when the door is opened.

In addition, the fire evacuation room may include various facilities that may create a comfortable and safe environment in the evacuation space.

For example, a lamp 15 may be installed on the ceiling inside the evacuation room main body 10, and the lamp 15 may be powered ON/OFF by receiving power from the control box 16.

In addition, the lamp 15 may be turned on or off in association with the opening and closing operation of the door 11, or by operating a separate switch (not shown) installed inside the evacuation room main body 10.

As another example, an air reservoir (not shown) or an oxygen tank (not shown) may be provided on one side of the interior of the evacuation room main body 10, and accordingly, persons who have difficulty in breathing among the evacuees may effectively use the air reservoir or the oxygen tank.

When the air reservoir or the oxygen tank is provided inside the evacuation room main body 10, the evacuees may breathe for a certain period of time using the air reservoir or the oxygen tank without supplying air from the outside so that the installation structure of the fire evacuation room may be more simplified.

For example, the fire evacuation room may be manufactured to have a structure in which only a nozzle (not shown) or a fine hole (not shown) is provided at the end of the air discharge pipe 12 to block the air intake pipe 12 of the evacuation room main body 10 while allowing a minimum amount of air to be discharged. Accordingly, the evacuees may wait for the rescue team in the evacuation room main body 10 while breathing by using the air reservoir or the oxygen tank even if there is no external air supply.

In this case, it is preferable to install the check valve (not shown) in the air discharge pipe 13 to prevent smoke or the like from flowing back to the air discharge pipe 13.

In the case of the fire evacuation room having the above configuration, since the connection work with the pipe for supplying air can be excluded, the installation structure may be very simple, and eventually, the fire evacuation room may be efficiently and economically utilized by residents.

As another example, a warning light (not shown) that outputs light and sound when a fire is detected through a fire detection sensor (not shown) may be provided at an outside of the evacuation room main body 10. Accordingly, evacuees or rescue personnel may quickly identify the fire evacuation room so that the evacuees may be evacuated or the rescue personnel may rescue the evacuees.

In addition, the fire evacuation room may include an air conditioner 22 as a means for keeping the internal environment of the evacuation room main body 10 pleasantly and safely.

The air conditioner 22 may be installed on the inner rear wall of the evacuation room main body 10. When the air intake and discharge system malfunctions or when the evacuation room main body 10 is heated so that internal air thereof becomes hot even in the normal operation of the air intake and discharge system, the air conditioner 22 may be operated to cool the air inside the evacuation space.

The ON/OFF operation of the air conditioner 22 may be performed under the output control of the control box 16 in response to a signal from a temperature sensor (not shown) that senses the temperature in the evacuation space, or may be performed as the evacuee manipulates a separate switch (not shown).

In addition, the fire evacuation room may include the control box 16 as a means for controlling the output of various devices as well as supplying power.

The control box 16 may be equipped with a charger, a battery, and the like, which can provide power itself, and may be installed at one side of an interior of the evacuation room main body 10, for example, at an inner rear wall of the evacuation room main body 10 to supply power while controlling electric appliances.

For example, the control box 16 may be electrically connected to the compulsive air discharge fan 14, the lamp 15, the warning light (not shown), the air conditioner 22, and the like installed in the evacuation room main body 10 to supply the power. In addition, the control box 116 may control the output of the electric appliances such as the compulsive air discharge fan 14, the lamp 15, the warning light (not shown), the air conditioner 22, and the like based on the signals received from a door sensor, a temperature sensor, a fire sensor, etc.

Figure 7:
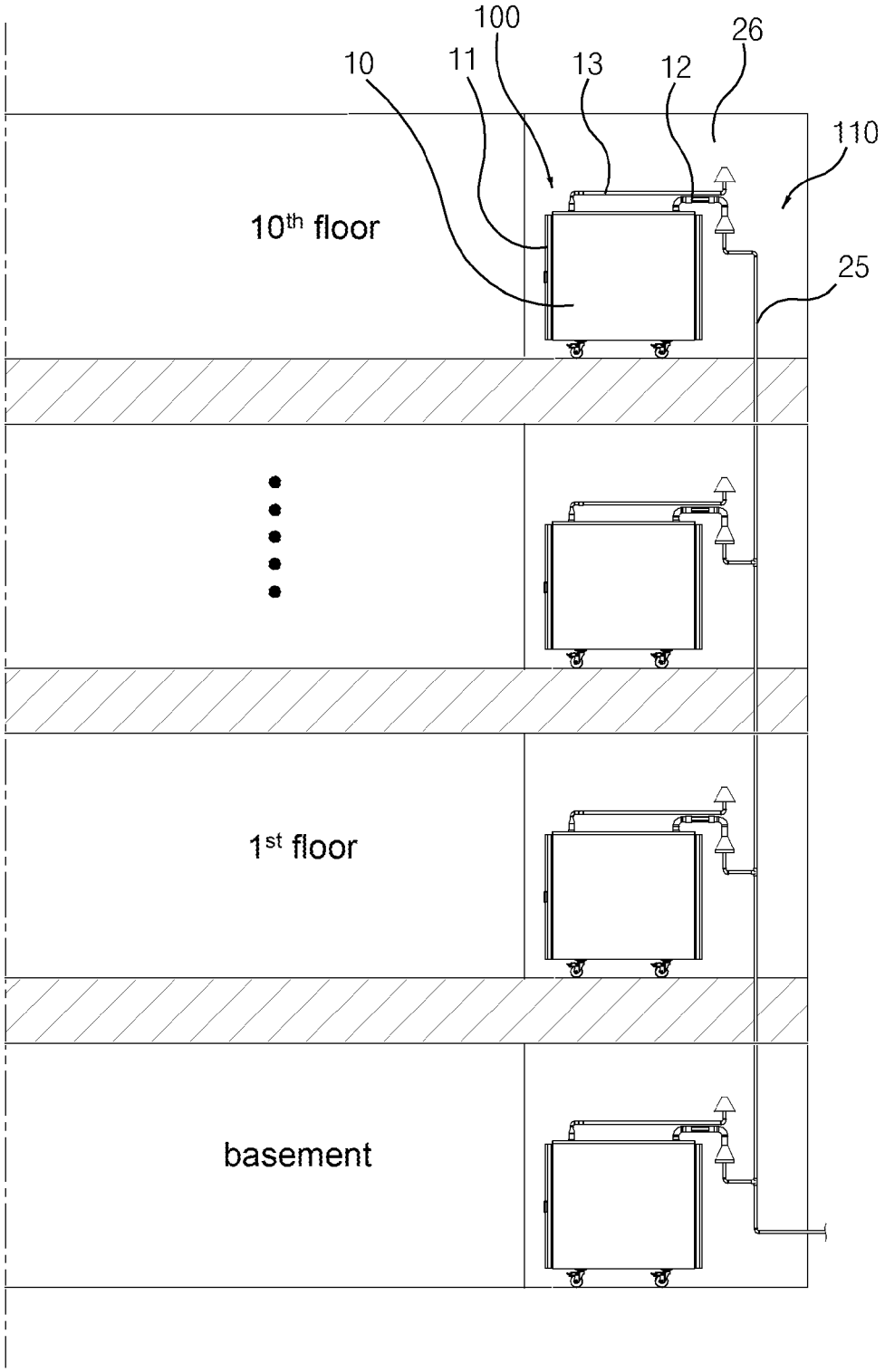
FIG. 7 is a schematic view showing an example of the installation state of the fire evacuation room according to the first embodiment of the present invention.

FIG. 7 is a schematic view showing an example of an installation state of a fire evacuation room according to an embodiment of the present invention.

As shown in FIG. 7, fire evacuation rooms 100 may be installed in evacuation rooms 26 provided in each floor of a building 110 such as a high-rise apartment or a high-rise building, and the air intake pipe 12 of each fire evacuation room installed as described above may be connected to a pipe 25 of the ventilation system installed in the building 110, for example, a pipe 25 extending to the evacuation room 26 of each floor from a machine room or the like of the building 110.

That is, the air intake pipe 12 of each fire evacuation room 100 provided in each evacuation room 26 may be connected a line branching from the pipe 25 installed along each evacuation room 26 of the building 110, so that the air introduced through the pipe 25 may be supplied to each fire evacuation room 100 through the air intake pipe 12.

Therefore, when a fire occurs, if the evacuees who have not escaped the building 110 open the door 11 of the fire evacuation room 100 provided inside the evacuation room 26, and the compulsive air discharge fan (reference numeral 14 of FIG. 4) may be operated to forcibly blow a wind from the inside to the outside of the fire evacuation room 100, so that the external smoke or heat may not enter the interior of the fire evacuation room 100. In this state, if the door 11 is closed after the evacuees enter the interior of the fire evacuation room 100, the operation of the compulsive air discharge fan (reference numeral 14 in FIG. 4) may be stopped.

At the same time, the air supplied from the pipe 25 of the ventilation system of the building may be supplied to the interior of the fire evacuation room 100 through the air intake pipe 12, and then the air may be partially discharged through the air discharge pipe 13. Thus, since the air can be properly supplied and discharged, evacuees inside the fire evacuation room 100 may be safely stayed without breathing problems until the rescue personnel arrive.

The method of supplying the air through the pipe 25 may be implemented such that the air can be supplied as an external manager or the like, who recognizes the fire, operates the ventilation system, however, it is preferred to supply the air simultaneously with the closing of the door 11 of the fire evacuation room 100 by interworking the control box 16, to which the opening and closing signals of the fire evacuation room 100 are input, with a control panel (not shown) of the ventilation system, in such a manner that the air supply to each fire evacuation room 100 can be collectively managed in the interior area of the building.

As another example, the air supply to the fire evacuation room 100 may be achieved through the pipe 25 of a separate blower (not shown) installed in the building.

Therefore, when a fire occurs in a building, evacuees who have not escaped from the building may quickly move to the fire evacuation room and wait for the rescue so that damage to persons caused by the fire can be minimized and the evacuees can be safely protected as much as possible.

Figure 8:
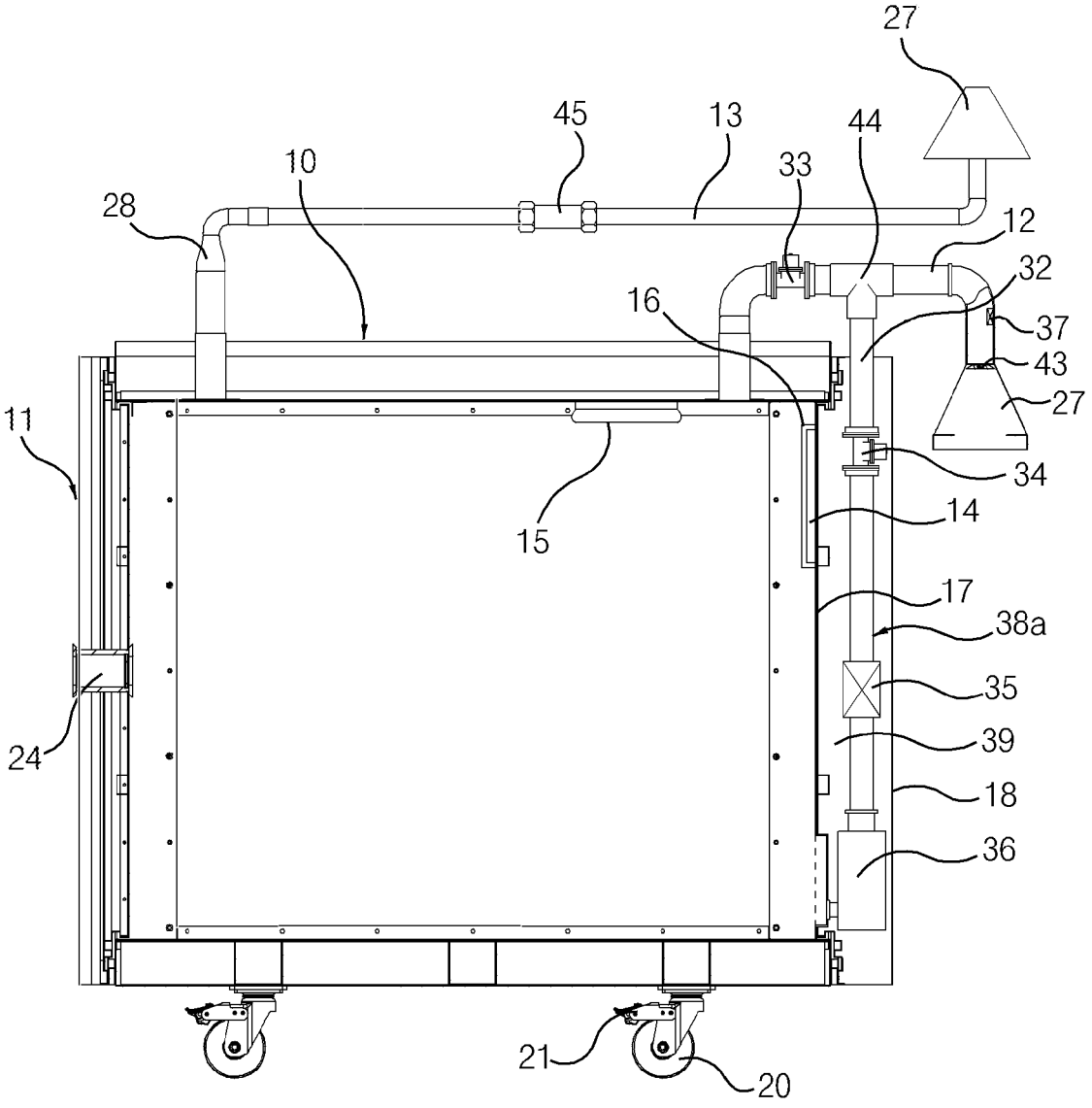
FIG. 8 is a sectional view showing a fire evacuation room according to a second embodiment of the present invention.

FIG. 8 is a sectional view showing a fire evacuation room according to a second embodiment of the present invention.

As shown in FIG. 8, the fire evacuation room may have an evacuation room main body 10 installed inside a building and having an entrance formed at a front thereof and an evacuation space formed therein, and an openable door 11 installed in the entrance of the evacuation room main body 10.

The evacuation room main body 10 may have a rectangular box-like structure having an evacuation space where a large number of persons can be stayed for evacuation, and the entrance, which is formed at the front of the evacuation room main body 10 for access of persons, may be opened.

For example, the evacuation room main body 10 may have the rectangular box-like structure including upper and lower walls, left and right walls, and a rear wall, and a front portion thereof corresponding to the entrance may be opened.

Each of the walls of the evacuation room main body 10 may have a double panel structure including an inner panel 17 and an outer panel 18, which are formed of a metal material and define a gap therebetween. Thus, the evacuation room main body 10 may have the structural rigidity and heat insulation property.

In this case, a plurality of "⊏"-shaped or rectangular tube-shaped reinforcing members may be interposed between the inner and outer panels 17 and 18, so that the inner and outer panels 17 and 18 may be fastened to each other, thereby maintaining the overall structural rigidity of the walls.

In addition, a wall heat shield member 29 having a predetermined bent shape may be inserted into a joint portion between the walls of the evacuation room main body 10.

The wall heat shield member 29 may be formed of a band-shaped member having a substantially "⊔" shaped section, arranged in parallel to the joint portion between the walls, and fixed to the walls by a rivet fastening structure or welding, etc.

In addition, a silica rope 30 may be inserted into a groove formed in a section of the wall heat shield member 29, and the silica rope 30 may serve to effectively block heat transmitted through the walls.

Accordingly, when heat is transferred to the evacuation room main body 10 in the event of a fire, most of the heat may be blocked by the thick wall. In addition, the heat transferred through the joint portion between the walls may also be completely blocked due to the extension of the heat transfer path by the bent shape of wall heat shield member 29, the minimization of the thermal conductivity by the reduction of a thermal contact section, and the thermal barrier action by the silica rope 30

In particular, a bulletproof plate 19 woven from Kevlar fibers may be attached to an inside of the inner panel 17 and the outer panel 18 constituting each wall of the evacuation room main body 10, that is, an inner surface of the inner panel 17, thereby effectively preventing debris generated upon explosion in the event of a fire from penetrating into the evacuation space through the wall. Thus, it is possible not only to prevent human injury, but also to prevent the internal air from leaking by preventing the evacuation room main body 10 from being damaged or broken.

In addition, four wheels 20 including front and rear wheels and left and right wheels and a well-known stopper 21 may be installed on the bottom surface of the evacuation room main body 10, so that the user may easily move the evacuation room main body 10 and may easily install the evacuation room main body 10 in a desired place.

The door 11 may be a hinge-type fire door installed at the entrance of the evacuation room main body 10 and may be opened and closed in the entrance installed at the front of the evacuation room main body 10 by using a hinge part (not shown) formed at one side of the door 11.

Further, the door 11 may be opened or closed by manipulating a well-known opening and closing handle 22, which is installed at one side of a front surface of the door 11 and has a lock/unlock function. In the closed state of the door 11, the circumference of the entrance of the evacuation room main body 10 may be maintained in a completely closed state.

A door panel of the door 11 may have a double panel structure including the inner panel 17 and the outer panel 18, which are formed of a metal material and define a gap therebetween. Thus, the door 11 may have the structural rigidity and heat insulation property. In this case, a plurality of "⊏"-shaped or rectangular tube-shaped reinforcing ⊏ members may be interposed between the inner and outer panels 17 and 18, so that the inner and outer panels 17 and 18 may be fastened to each other, thereby maintaining the overall structural rigidity of the panel.

The bulletproof plate 19 woven from Kevlar fibers may be attached to an inside of the inner panel 17 and the outer panel 18 constituting the door panel of the door 11, that is, an inner surface of the inner panel 17, thereby effectively preventing debris generated upon explosion in the event of a fire from penetrating into the evacuation space through the panel. Thus, it is possible not only to prevent human injury, but also to prevent the internal air from leaking by preventing the evacuation room main body 10 from being damaged or broken.

In addition, the door 11 is provided with a confirmation window 23 formed through the inner and outer panels 17 and 18. Thus, persons inside the evacuation room main body 10 and rescue personnel outside the evacuation room main body 10 may check the status of each other.

In particular, the door 11 may be provided with a door heat shield member 31 having a nine-step bent section, so that the thermal conductivity through the door 11 may be reduced as much as possible.

The door heat shield member 21 may be arranged along edges of four sides between the inner panel 17 and the outer panel 18 and fastened to the panel by a rivet fastening structure or welding.

Accordingly, when heat is transferred to the door 11 in the event of a fire, the heat may be transferred through the nine-step bent section of the door heat shield member 31, that is, through a long heat transfer path, so that the thermal conductivity may be minimized, and thus, the thermal conduction through the door 11 may be completely blocked.

In addition, the fire evacuation room may include an air intake pipe 12 connected to a rear portion of a ceiling of the evacuation room main body 10 to serve as a passage for air entering the evacuation space and an air discharge pipe 13 connected to a front portion of the ceiling of the evacuation room main body 10 to serve as a passage for air exiting the evacuation space.

The air intake pipe 12 may be a tube formed of a metal pipe or the like, and communicate with a rear evacuation space by passing through the inner panel 17 and the outer panel 18 of an upper wall of the evacuation room main body 10. The air intake pipe 12 having the above configuration may extend rearward of the evacuation room main body 10 by a predetermined length.

In addition, a rear end portion of the air intake pipe 12 having the above configuration may be connected to a pipe 25 of a ventilation system of the building or a pipe 25 of a blower separately installed in the building to receive air, which will be described below.

According to another embodiment, when the air intake pipe 12 has a structure capable of solely inhaling air without being connected to the pipe 25 of the ventilation system of the building or the pipe 25 of the blower of the building, an air intake fan 43 may be installed at an outer end of the air intake pipe 12. Accordingly, when the air intake fan 43 is operated, external air may be is introduced through the air intake pipe 12 and supplied to the evacuation room main body 10.

In addition, a sensor 37 may be installed at an outer end of the air intake pipe 12, and the sensor 37 detects toxic gases such as smoke flowing through the air intake pipe 12 and the signal detected by the sensor 37 may be sent to the control box 16.

The sensor 37 may be a well-known sensor that detects toxic gases, combustible gases, and the like.

The air intake pipe 12 may have a double-pipe structure so that it is possible to prevent the air flowing into the evacuation space formed inside the evacuation room main body 10 through the air intake pipe 12 from being heated, thereby completely solving the problem such as the difficulty in breathing of the evacuee caused by the heated air.

In addition, a first solenoid valve 33 may be installed at one side of the air intake pipe 12, for example, a section between a pipe tee 44 to be described later and the evacuation room main body 10. The first solenoid valve 33 may be turned ON (opened) or turned OFF (closed) under the control of the control box 16.

For example, the first solenoid valve 33 always maintains an ON (open) state. In this state, when a toxic gas detection signal is input to the control box 16 from the sensor 37, the first solenoid valve 33 may be turned OFF (closed) under the output control of the control box 16, and accordingly, the air intake pipe 12 may be blocked so that the toxic gas as well as the air may be prevented from being introduced into the interior of the evacuation room main body 10 through the air intake pipe 12.

The air discharge pipe 13 may be a tube formed of a metal pipe or the like, and communicate with a front evacuation space by passing through the inner panel 17 and the outer panel 18 of the upper wall of the evacuation room main body 10. The air intake pipe 12 having the above configuration may extend rearward of the evacuation room main body 10 by a predetermined length.

A rear end portion of the air discharge pipe 13 having the above configuration may be exposed to the interior of the evacuation room (26 in FIG. 7) provided inside the building. Accordingly, the air discharged from the interior of the evacuation room main body 10 may be discharged to the evacuation room through the air discharge pipe 13.

The end portion of the air discharge pipe 13, that is, the end portion, which is bent upward, may be provided with a conical shade 27, and the conical shade 27 may prevent foreign substances such as dust from entering the interior of the air discharge pipe 13.

In particular, the internal evacuation space of the evacuation room main body 10 may be always maintained in an environment in which a constant differential pressure is created, so that a sufficient amount of air required for breathing may remain in the evacuation space.

To this end, a diameter of the air intake pipe 12 may be relatively larger than a diameter of the air discharge pipe 13.

In this case, a ratio of the diameter of the air discharge pipe 13 to the diameter of the air intake pipe 12 may be about 60%, for example, the diameter of the air intake pipe 12 may be about 50 mm, and the diameter of the discharge pipe 13 may be about 30 mm.

A connecting portion of the air discharge pipe 13 to the evacuation room main body 10 may have a diameter the same as the diameter of the air intake pipe 12, so that the air initially discharged from the interior of the evacuation room main body 10 may flow smoothly. In addition, since a tapered shaft pipe portion 28 is provided in the initial section of the air discharge pipe 13, the remaining section of the air discharge pipe 13 may have a relatively small diameter as compared with the air intake pipe 12.

Therefore, since the diameter of the air intake pipe 12 is relatively larger than the diameter of the air discharge pipe 13, the amount of air entering the evacuation space may be greater than the amount of air exiting the evacuation space, thereby always maintaining the constant differential pressure in the evacuation space.

As a result, even if a leak occurs due to the breakage of the evacuation room main body 10 caused by external impact such as falling objects, explosions, etc. in the event of a fire, it is possible to compensate for the leak. Therefore, the evacuees may breathe without a special problem due to the amount of air remaining in the evacuation room main body 10 so that the safety of evacuees may be ensured as much as possible.

Further, the external smoke, flame, contaminated air, etc. may be prevented from flowing back through the air discharge pipe 13 due to the differential pressure created in the evacuation space formed in the evacuation room main body 10 so that the safety of evacuees may be further secured.

In addition, a check valve 45 may be installed in the air discharge pipe 13, so that the air inside the evacuation room main body 10 may be discharged through the air discharge pipe 13, and external air, smoke, toxic gas, etc. may be prevented from flowing back to the interior of the evacuation room main body 10 through the air discharge pipe 13.

In addition, the fire evacuation room may include a compulsive air discharge fan 14 that prevents the external smoke or heat from entering the interior of the evacuation room main body 10 when the evacuee opens the door 11 to enter the interior of the evacuation room main body 10.

The compulsive air discharge fan 14 may be installed on the inner rear wall of the evacuation room main body 10 while facing the entrance, that is, a front of the door 11, and may be turned ON when the door 11 is opened and turned OFF when the door 11 is closed.

To this end, a well-known door detection sensor (not shown) may be installed on one side of the entrance of the evacuation room main body 10, and when the door detection sensor detects the opening of the door 11, the detection signal may be input into the control box 16, and at the same time, the compulsive air discharge fan 14 may be operated under the output control of the control box 16, that is, the door 11 may be opened, and at the same time, strong wind may blow outward from the interior of the evacuation room main body 10, so that it is possible to completely block the external smoke or heat from entering the evacuation space when the door is opened.

In addition, the fire evacuation room may include various facilities that may create a comfortable and safe environment in the evacuation space.

For example, a lamp 15 may be installed on the ceiling inside the evacuation room main body 10, and the lamp 15 may be powered ON/OFF by receiving power from the control box 16.

In addition, the lamp 15 may be turned on or off in association with the opening and closing operation of the door 11, or by operating a separate switch (not shown) installed inside the evacuation room main body 10.

As another example, an air reservoir (not shown) or an oxygen tank (not shown) may be provided on one side of the interior of the evacuation room main body 10, and accordingly, persons who have difficulty in breathing among the evacuees may effectively use the air reservoir or the oxygen tank.

When the air reservoir or the oxygen tank is provided inside the evacuation room main body 10, the evacuees may breathe for a certain period of time using the air reservoir or the oxygen tank without supplying air from the outside so that the installation structure of the fire evacuation room may be more simplified.

For example, the fire evacuation room may be manufactured to have a structure in which only a nozzle (not shown) or a fine hole (not shown) is provided at the end of the air discharge pipe 12 to block the air intake pipe 12 of the evacuation room main body 10 while allowing a minimum amount of air to be discharged. Accordingly, the evacuees may wait for the rescue team in the evacuation room main body 10 while breathing by using the air reservoir or the oxygen tank even if there is no external air supply.

In this case, it is preferable to install the check valve (not shown) in the air discharge pipe 13 to prevent smoke or the like from flowing back to the air discharge pipe 13.

In the case of the fire evacuation room having the above configuration, since the connection work with the pipe for supplying air can be excluded, the installation structure may be very simple, and eventually, the fire evacuation room may be efficiently and economically utilized by residents.

As another example, a warning light (not shown) that outputs light and sound when a fire is detected through a fire detection sensor (not shown) may be provided at an outside of the evacuation room main body 10. Accordingly, evacuees or rescue personnel may quickly identify the fire evacuation room so that the evacuees may be evacuated or the rescue personnel may rescue the evacuees.

In addition, the fire evacuation room may include an air conditioner 22 as a means for keeping the internal environment of the evacuation room main body 10 pleasantly and safely.

The air conditioner 22 may be installed on the inner rear wall of the evacuation room main body 10. When the air intake and discharge system malfunctions or when the evacuation room main body 10 is heated so that internal air thereof becomes hot even in the normal operation of the air intake and discharge system, the air conditioner 22 may be operated to cool the air inside the evacuation space.

The ON/OFF operation of the air conditioner 22 may be performed under the output control of the control box 16 in response to a signal from a temperature sensor (not shown) that senses the temperature in the evacuation space, or may be performed as the evacuee manipulates a separate switch (not shown).

In addition, the fire evacuation room may include the control box 16 as a means for controlling the output of various devices as well as supplying power.

The control box 16 may be equipped with a charger, a battery, and the like, which can provide power itself, and may be installed at one side of an interior of the evacuation room main body 10, for example, at an inner rear wall of the evacuation room main body 10 to supply power while controlling electric appliances.

For example, the control box 16 may be electrically connected to the compulsive air discharge fan 14, the lamp 15, the warning light (not shown), the air conditioner 22, and the like installed in the evacuation room main body 10 to supply the power. In addition, the control box 116 may control the output of the electric appliances such as the compulsive air discharge fan 14, the lamp 15, the warning light (not shown), the air conditioner 22, and the like based on the signals received from a door sensor, a temperature sensor, a fire sensor, etc. In addition, the control box 16 may control not only the output of the first solenoid valve 33 disposed on the air intake pipe 12, but also the outputs of the second solenoid valve 34 and the oxygen generator 36 disposed on the sub-air intake pipe 32, and the outputs of the pump 41 and the third solenoid valve 42 disposed on a discharge side of the air storage tank 40.

In addition, the fire evacuation room may include an air supply device 38*a* for breathing as a means for safely protecting the evacuees by perfectly blocking the penetration of toxic gases into the fire evacuation room.

The air supply device 38*a* for breathing may immediately block the air intake pipe 12 when toxic gas such as smoke is detected in the air flowing into the air intake pipe 12, and simultaneously intake the air through the sub-air intake pipe 32 to purify the toxic gas. In addition, the air supply device 38*a* for breathing may generate oxygen to supply the oxygen to the interior of the evacuation room main body 10.

To this end, a pipe tee 44 may be installed on one side of the air intake pipe 12, and the sub-air intake pipe 32 branching from the pipe tee 44 installed as described above may vertically downward extend.

In addition, the second solenoid valve 34 may be installed on the sub-air intake pipe 32, and the output of the second solenoid valve 34 may be controlled by the control box 16 so that the second solenoid valve 34 may be turned On (open) or turned OFF (closed).

For example, when the air intake pipe 12 is blocked by the OFF operation of the first solenoid valve 33, the second solenoid valve 34 may be turned ON to allow the air to flow toward the sub-air intake pipe 32. When the external air is normally supplied through the air intake pipe 12, the second solenoid valve 34 may be kept in the OFF state.

In addition, the sub-air intake pipe 32 may be provided with a filter device 35 that purifies the toxic gas contained in the air.

Accordingly, when the air (air containing toxic gas) flowing into the sub-air intake pipe 32 passes through the filter device 35, the toxic gas contained in the air may be removed, so that clean purified air having no toxic gas may be supplied to the oxygen generator 36.

The filter device 35 may include a purifier, canister, etc. used for gas masks.

In particular, the air supply device 38*a* for breathing may include the oxygen generator 36 that generate oxygen to supply the oxygen to the interior of the evacuation room main body 10.

The sub-air intake pipe 32 may be connected to an intake side of the oxygen generator 36, and the discharge side of the oxygen generator 36 may be connected to the interior of the evacuation room main body 10 through the pipe or the like. The oxygen generator 36 may be turned ON or OFF under the output control of the control box 16.

Accordingly, the air that has passed through the filter device 35, that is, the air from which the toxic gases have been removed may flow into the intake side of the oxygen generator 36, and the oxygen produced inside the oxygen generator 36 may be supplied to the interior of the evacuation room main body 10.

A method of producing the oxygen in the oxygen generator 36 may be adopted from various methods generally known in the art without special limitation.

In addition, the sub-air intake pipe 32, the second solenoid valve 34, the filter device 35 and the oxygen generator 36 of the air supply device 38*a* for breathing may be installed in a space 39 defined inside the wall of the evacuation room main body 10.

For example, the sub-air intake pipe 32 extending from the pipe tee 44 on the air intake pipe 12 may be vertically installed by passing through an upper portion of the wall in the space 39 between the inner panel 17 and the outer panel 18 constituting the rear wall of the evacuation room main body 10, and the sub-air intake pipe 32 installed as described above may be connected to the second solenoid valve 34, the filter device 35 and the oxygen generator 36 installed inside the space 39, and the discharge side of the oxygen generator 36 may be connected to the intake side such as a wire mesh on the inner panel 17 so that the oxygen may be supplied into the interior of the evacuation room main body 10.

Therefore, in the event of a fire, the sensor 37 may detect the toxic gas such as smoke contained in the air introduced through the air intake pipe 12.

When the detection signal of the sensor 37 is input to the control box 16, the first solenoid valve 33 may be turned OFF to be closed, and at the same time, the second solenoid valve 34 may be turned ON to be opened under the output control of the control box 16. From this point, the external air may flow toward the sub-air intake pipe 32 and the oxygen generator 36 may start to operate under the output control of the control box 16.

Subsequently, the air flowing into the sub-air intake pipe 32 may pass through the filter device 35 and the toxic gas contained in the air may be removed in this process. The air purified through the filter device 35 may be introduced into the oxygen generator 36.

Thereafter, the oxygen generated by the operation of the oxygen generator 36 may be supplied to the interior of the evacuation room main body 10 to allow the evacuee to breathe.

As described above, the introduction of the external toxic gas may be perfectly blocked and the oxygen may be supplied for breathing, so it is possible to protect the evacuee from the danger of toxic gas and ensure safety of the evacuee as much as possible.

Figure 9:
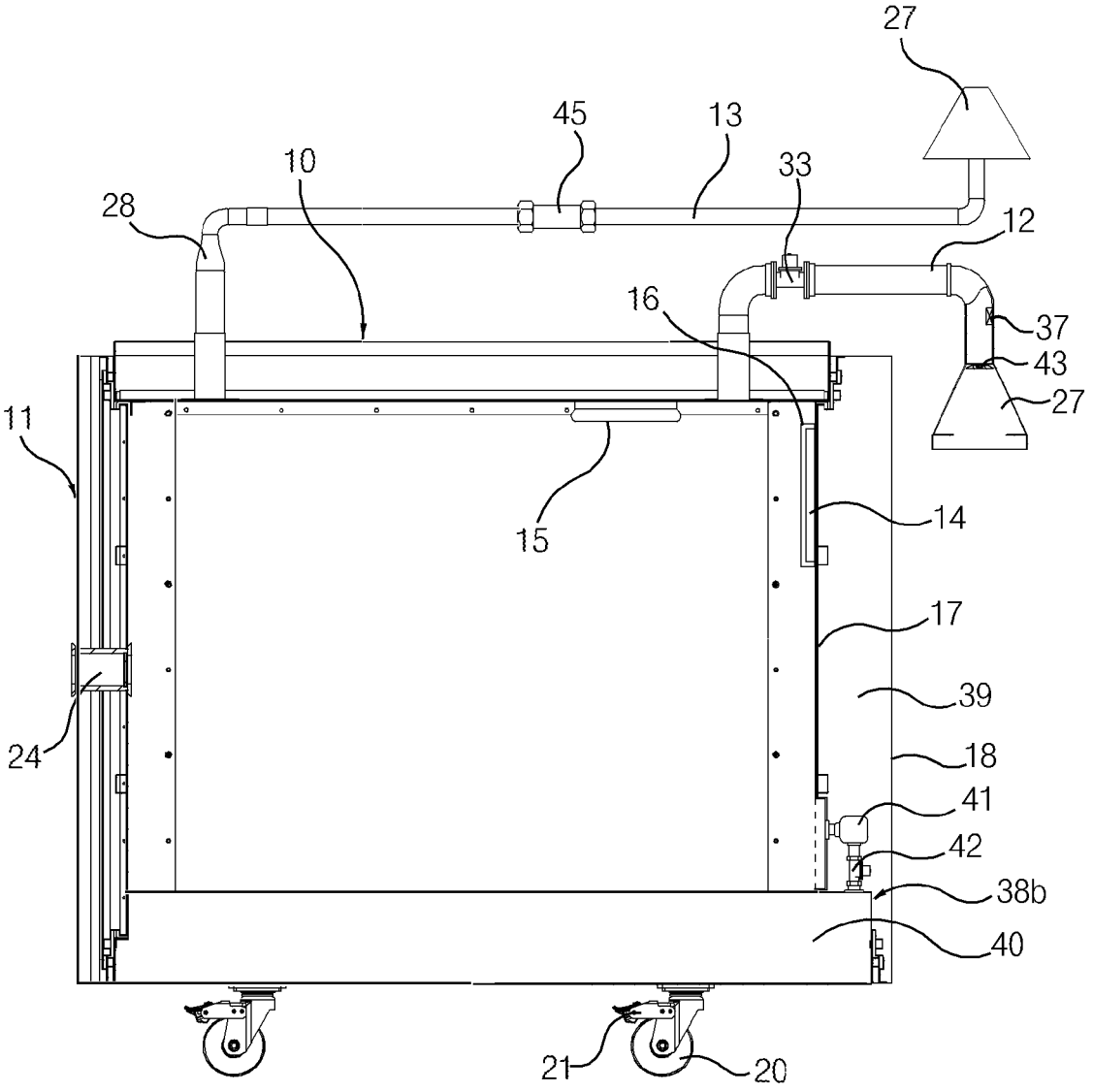
FIG. 9 is a sectional view showing a fire evacuation room according to a third embodiment of the present invention.

FIG. 9 is a sectional view showing a fire evacuation room according to a third embodiment of the present invention.

As shown in FIG. 9, the fire evacuation room may have an evacuation room main body 10 installed inside a building and having an entrance formed at a front thereof and an evacuation space formed therein, and an openable door 11 installed in the entrance of the evacuation room main body 10.

The evacuation room main body 10 may have a rectangular box-like structure having an evacuation space where a large number of persons can be stayed for evacuation, and the entrance, which is formed at the front of the evacuation room main body 10 for access of persons, may be opened.

For example, the evacuation room main body 10 may have the rectangular box-like structure including upper and lower walls, left and right walls, and a rear wall, and a front portion thereof corresponding to the entrance may be opened.

Each of the walls of the evacuation room main body 10 may have a double panel structure including an inner panel 17 and an outer panel 18, which are formed of a metal material and define a gap therebetween. Thus, the evacuation room main body 10 may have the structural rigidity and heat insulation property.

In this case, a plurality of "ㄷ"-shaped or rectangular tube-shaped reinforcing members may be interposed between the inner and outer panels 17 and 18, so that the inner and outer panels 17 and 18 may be fastened to each other, thereby maintaining the overall structural rigidity of the walls.

In addition, a wall heat shield member 29 having a predetermined bent shape may be inserted into a joint portion between the walls of the evacuation room main body 10.

The wall heat shield member 29 may be formed of a band-shaped member having a substantially "ㄹ" shaped section, arranged in parallel to the joint portion between the walls, and fixed to the walls by a rivet fastening structure or welding, etc.

In addition, a silica rope 30 may be inserted into a groove formed in a section of the wall heat shield member 29, and the silica rope 30 may serve to effectively block heat transmitted through the walls.

Accordingly, when heat is transferred to the evacuation room main body 10 in the event of a fire, most of the heat may be blocked by the thick wall. In addition, the heat transferred through the joint portion between the walls may also be completely blocked due to the extension of the heat transfer path by the bent shape of wall heat shield member 29, the minimization of the thermal conductivity by the reduction of a thermal contact section, and the thermal barrier action by the silica rope 30.

In particular, a bulletproof plate 19 woven from Kevlar fibers may be attached to an inside of the inner panel 17 and the outer panel 18 constituting each wall of the evacuation room main body 10, that is, an inner surface of the inner panel 17, thereby effectively preventing debris generated upon explosion in the event of a fire from penetrating into the evacuation space through the wall. Thus, it is possible not only to prevent human injury, but also to prevent the internal air from leaking by preventing the evacuation room main body 10 from being damaged or broken.

In addition, four wheels 20 including front and rear wheels and left and right wheels and a well-known stopper 21 may be installed on the bottom surface of the evacuation room main body 10, so that the user may easily move the evacuation room main body 10 and may easily install the evacuation room main body 10 in a desired place.

The door 11 may be a hinge-type fire door installed at the entrance of the evacuation room main body 10 and may be opened and closed in the entrance installed at the front of the evacuation room main body 10 by using a hinge part (not shown) formed at one side of the door 11.

Further, the door 11 may be opened or closed by manipulating a well-known opening and closing handle 22, which is installed at one side of a front surface of the door 11 and has a lock/unlock function. In the closed state of the door 11, the circumference of the entrance of the evacuation room main body 10 may be maintained in a completely closed state.

A door panel of the door 11 may have a double panel structure including the inner panel 17 and the outer panel 18, which are formed of a metal material and define a gap therebetween. Thus, the door 11 may have the structural rigidity and heat insulation property. In this case, a plurality of "ㄷ"-shaped or rectangular tube-shaped reinforcing members may be interposed between the inner and outer panels 17 and 18, so that the inner and outer panels 17 and 18 may be fastened to each other, thereby maintaining the overall structural rigidity of the panel.

The bulletproof plate 19 woven from Kevlar fibers may be attached to an inside of the inner panel 17 and the outer panel 18 constituting the door panel of the door 11, that is, an inner surface of the inner panel 17, thereby effectively preventing debris generated upon explosion in the event of a fire from penetrating into the evacuation space through the panel. Thus, it is possible not only to prevent human injury, but also to prevent the internal air from leaking by preventing the evacuation room main body 10 from being damaged or broken.

In addition, the door 11 is provided with a confirmation window 23 formed through the inner and outer panels 17 and 18. Thus, persons inside the evacuation room main body 10 and rescue personnel outside the evacuation room main body 10 may check the status of each other.

In particular, the door 11 may be provided with a door heat shield member 31 having a nine-step bent section, so that the thermal conductivity through the door 11 may be reduced as much as possible.

The door heat shield member 21 may be arranged along edges of four sides between the inner panel 17 and the outer panel 18 and fastened to the panel by a rivet fastening structure or welding.

Accordingly, when heat is transferred to the door 11 in the event of a fire, the heat may be transferred through the nine-step bent section of the door heat shield member 31, that is, through a long heat transfer path, so that the thermal conductivity may be minimized, and thus, the thermal conduction through the door 11 may be completely blocked.

In addition, the fire evacuation room may include an air intake pipe 12 connected to a rear portion of a ceiling of the evacuation room main body 10 to serve as a passage for air entering the evacuation space and an air discharge pipe 13 connected to a front portion of the ceiling of the evacuation room main body 10 to serve as a passage for air exiting the evacuation space.

The air intake pipe 12 may be a tube formed of a metal pipe or the like, and communicate with a rear evacuation space by passing through the inner panel 17 and the outer panel 18 of an upper wall of the evacuation room main body 10. The air intake pipe 12 having the above configuration may extend rearward of the evacuation room main body 10 by a predetermined length.

In addition, a rear end portion of the air intake pipe 12 having the above configuration may be connected to a pipe 25 of a ventilation system of the building or a pipe 25 of a blower separately installed in the building to receive air, which will be described below.

According to another embodiment, when the air intake pipe 12 has a structure capable of solely inhaling air without being connected to the pipe 25 of the ventilation system of the building or the pipe 25 of the blower of the building, an air intake fan 43 may be installed at an outer end of the air intake pipe 12. Accordingly, when the air intake fan 43 is operated, external air may be is introduced through the air intake pipe 12 and supplied to the evacuation room main body 10.

In addition, a sensor 37 may be installed at an outer end of the air intake pipe 12, and the sensor 37 detects toxic gases such as smoke flowing through the air intake pipe 12 and the signal detected by the sensor 37 may be sent to the control box 16.

The sensor 37 may be a well-known sensor that detects toxic gases, combustible gases, and the like.

The air intake pipe 12 may have a double-pipe structure so that it is possible to prevent the air flowing into the evacuation space formed inside the evacuation room main body 10 through the air intake pipe 12 from being heated, thereby completely solving the problem such as the difficulty in breathing of the evacuee caused by the heated air.

In addition, a first solenoid valve 33 may be installed at one side of the air intake pipe 12, and the first solenoid valve 33 installed as described above may be turned ON (opened) or turned OFF (closed) under the control of the control box 16.

For example, the first solenoid valve 33 always maintains an ON (open) state. In this state, when a toxic gas detection signal is input to the control box 16 from the sensor 37, the first solenoid valve 33 may be turned OFF (closed) under the output control of the control box 16, and accordingly, the air intake pipe 12 may be blocked so that the toxic gas as well as the air may be prevented from being introduced into the interior of the evacuation room main body 10 through the air intake pipe 12.

The air discharge pipe 13 may be a tube formed of a metal pipe or the like, and communicate with a front evacuation space by passing through the inner panel 17 and the outer panel 18 of the upper wall of the evacuation room main body 10. The air intake pipe 12 having the above configuration may extend rearward of the evacuation room main body 10 by a predetermined length.

A rear end portion of the air discharge pipe 13 having the above configuration may be exposed to the interior of the evacuation room (26 in FIG. 7) provided inside the building. Accordingly, the air discharged from the interior of the evacuation room main body 10 may be discharged to the evacuation room through the air discharge pipe 13.

The end portion of the air discharge pipe 13, that is, the end portion, which is bent upward, may be provided with a conical shade 27, and the conical shade 27 may prevent foreign substances such as dust from entering the interior of the air discharge pipe 13.

In particular, the internal evacuation space of the evacuation room main body 10 may be always maintained in an environment in which a constant differential pressure is created, so that a sufficient amount of air required for breathing may remain in the evacuation space.

To this end, a diameter of the air intake pipe 12 may be relatively larger than a diameter of the air discharge pipe 13.

In this case, a ratio of the diameter of the air discharge pipe 13 to the diameter of the air intake pipe 12 may be about 60%, for example, the diameter of the air intake pipe 12 may be about 50 mm, and the diameter of the discharge pipe 13 may be about 30 mm.

A connecting portion of the air discharge pipe 13 to the evacuation room main body 10 may have a diameter the same as the diameter of the air intake pipe 12, so that the air initially discharged from the interior of the evacuation room main body 10 may flow smoothly. In addition, since a tapered shaft pipe portion 28 is provided in the initial section of the air discharge pipe 13, the remaining section of the air discharge pipe 13 may have a relatively small diameter as compared with the air intake pipe 12.

Therefore, since the diameter of the air intake pipe 12 is relatively larger than the diameter of the air discharge pipe 13, the amount of air entering the evacuation space may be greater than the amount of air exiting the evacuation space, thereby always maintaining the constant differential pressure in the evacuation space.

As a result, even if a leak occurs due to the breakage of the evacuation room main body 10 caused by external impact such as falling objects, explosions, etc. in the event of a fire, it is possible to compensate for the leak. Therefore, the evacuees may breathe without a special problem due to the amount of air remaining in the evacuation room main body 10 so that the safety of evacuees may be ensured as much as possible.

Further, the external smoke, flame, contaminated air, etc. may be prevented from flowing back through the air discharge pipe 13 due to the differential pressure created in the evacuation space formed in the evacuation room main body 10 so that the safety of evacuees may be further secured.

In addition, a check valve 45 may be installed in the air discharge pipe 13, so that the air inside the evacuation room main body 10 may be discharged through the air discharge pipe 13, and external air, smoke, toxic gas, etc. may be prevented from flowing back to the interior of the evacuation room main body 10 through the air discharge pipe 13.

In addition, the fire evacuation room may include a compulsive air discharge fan 14 that prevents the external smoke or heat from entering the interior of the evacuation room main body 10 when the evacuee opens the door 11 to enter the interior of the evacuation room main body 10.

The compulsive air discharge fan 14 may be installed on the inner rear wall of the evacuation room main body 10 while facing the entrance, that is, a front of the door 11, and may be turned ON when the door 11 is opened and turned OFF when the door 11 is closed.

To this end, a well-known door detection sensor (not shown) may be installed on one side of the entrance of the evacuation room main body 10, and when the door detection sensor detects the opening of the door 11, the detection signal may be input into the control box 16, and at the same time, the compulsive air discharge fan 14 may be operated under the output control of the control box 16, that is, the door 11 may be opened, and at the same time, strong wind may blow outward from the interior of the evacuation room main body 10, so that it is possible to completely block the external smoke or heat from entering the evacuation space when the door is opened.

In addition, the fire evacuation room may include various facilities that may create a comfortable and safe environment in the evacuation space.

For example, a lamp 15 may be installed on the ceiling inside the evacuation room main body 10, and the lamp 15 may be powered ON/OFF by receiving power from the control box 16.

In addition, the lamp 15 may be turned on or off in association with the opening and closing operation of the door 11, or by operating a separate switch (not shown) installed inside the evacuation room main body 10.

As another example, an air reservoir (not shown) or an oxygen tank (not shown) may be provided on one side of the interior of the evacuation room main body 10, and accordingly, persons who have difficulty in breathing among the evacuees may effectively use the air reservoir or the oxygen tank.

When the air reservoir or the oxygen tank is provided inside the evacuation room main body 10, the evacuees may breathe for a certain period of time using the air reservoir or the oxygen tank without supplying air from the outside so that the installation structure of the fire evacuation room may be more simplified.

For example, the fire evacuation room may be manufactured to have a structure in which only a nozzle (not shown) or a fine hole (not shown) is provided at the end of the air discharge pipe 12 to block the air intake pipe 12 of the evacuation room main body 10 while allowing a minimum amount of air to be discharged. Accordingly, the evacuees may wait for the rescue team in the evacuation room main body 10 while breathing by using the air reservoir or the oxygen tank even if there is no external air supply.

In this case, it is preferable to install the check valve (not shown) in the air discharge pipe 13 to prevent smoke or the like from flowing back to the air discharge pipe 13.

In the case of the fire evacuation room having the above configuration, since the connection work with the pipe for supplying air can be excluded, the installation structure may be very simple, and eventually, the fire evacuation room may be efficiently and economically utilized by residents.

As another example, a warning light (not shown) that outputs light and sound when a fire is detected through a fire detection sensor (not shown) may be provided at an outside of the evacuation room main body 10. Accordingly, evacuees or rescue personnel may quickly identify the fire evacuation room so that the evacuees may be evacuated or the rescue personnel may rescue the evacuees.

In addition, the fire evacuation room may include an air conditioner 22 as a means for keeping the internal environment of the evacuation room main body 10 pleasantly and safely.

The air conditioner 22 may be installed on the inner rear wall of the evacuation room main body 10. When the air intake and discharge system malfunctions or when the evacuation room main body 10 is heated so that internal air thereof becomes hot even in the normal operation of the air intake and discharge system, the air conditioner 22 may be operated to cool the air inside the evacuation space.

The ON/OFF operation of the air conditioner 22 may be performed under the output control of the control box 16 in response to a signal from a temperature sensor (not shown) that senses the temperature in the evacuation space, or may be performed as the evacuee manipulates a separate switch (not shown).

In addition, the fire evacuation room may include the control box 16 as a means for controlling the output of various devices as well as supplying power.

The control box 16 may be equipped with a charger, a battery, and the like, which can provide power itself, and may be installed at one side of an interior of the evacuation room main body 10, for example, at an inner rear wall of the evacuation room main body 10 to supply power while controlling electric appliances.

For example, the control box 16 may be electrically connected to the compulsive air discharge fan 14, the lamp 15, the warning light (not shown), the air conditioner 22, and the like installed in the evacuation room main body 10 to supply the power. In addition, the control box 116 may control the output of the electric appliances such as the compulsive air discharge fan 14, the lamp 15, the warning light (not shown), the air conditioner 22, and the like based on the signals received from a door sensor, a temperature sensor, a fire sensor, etc. In addition, the control box 16 may control not only the output of the first solenoid valve 33 disposed on the air intake pipe 12, but also the outputs of the second solenoid valve 34 and the oxygen generator 36 disposed on the sub-air intake pipe 32, and the outputs of the pump 41 and the third solenoid valve 42 disposed on a discharge side of the air storage tank 40.

In addition, the fire evacuation room may include an air supply device **38*b*** for breathing as a means for safely protecting the evacuees by perfectly blocking the penetration of toxic gases into the fire evacuation room.

The air supply device **38*b* for breathing may immediately block the air intake pipe 12 when toxic gas such as smoke is detected in the air flowing into the air intake pipe 12, and supply the air contained in the air storage tank 40 provided in the evacuation room main body 10 into the interior of the evacuation room main body 10**.

To this end, the air storage tank 40 filled with the air may be installed in a closed space formed in an internal space of a bottom member of the evacuation room main body 10, that is, formed between the inner panel 17 and the outer panel 18.

In this case, the air storage tank 40 may be formed over the entire area of the bottom member, and may have a volume capable of ensuring a sufficient amount of air in consideration of the number of persons accommodated in the evacuation room main body 10 and the evacuation time.

In addition, a third solenoid valve 42 may be installed on the pipe extending from the discharge side of the air storage tank 40. In this case, the pipe may be connected to the intake side of the pump 41, and the discharge side of the pump 41 may be connected to the intake side such as a wire mesh on the inner panel 17 so that air may be supplied to the interior of the evacuation room main body 10.

The pump 41 may be operated under the output control of the control box 16, the third solenoid valve 42 may also be turned ON or OFF under the output control of the control box 16 and the pipe may be located in the space between the inner and outer panels 17 and 18.

Accordingly, the first solenoid valve 33 may be turned OFF and the third solenoid valve 42 may be turned OFF under the output control of the control box 16 that receives the signal of the sensor 37 installed on the air intake pipe 12, at the same time, the pump 41 may be operated so that the air filled in the air storage tank 40 may be supplied to the interior of the evacuation room main body 10.

In addition, the pump 41 and the third solenoid valve 42 of the air supply device 38*b* for breathing may be installed in the space 39 defined inside the wall of the evacuation room main body 10.

For example, the pump 41 and the third solenoid valve 42 may be installed in the space 39 between the inner panel 17 and the outer panel 18 constituting the rear wall of the evacuation room main body 10, and the discharge side of the pump 41 may be connected to the intake side such as a wire mesh on the inner panel 17 so that the oxygen may be supplied into the interior of the evacuation room main body 10.

Therefore, in the event of a fire, the sensor 37 may detect the toxic gas such as smoke contained in the air introduced through the air intake pipe 12.

When the detection signal of the sensor 37 is input to the control box 16, the first solenoid valve 33 may be turned OFF to be closed, and at the same time, the third solenoid valve 42 may be turned ON to be opened under the output control of the control box 16. In addition, the pump 41 may also start to operate under the output control of the control box 16.

Thereafter, the air stored in the air storage tank 40 may be supplied to the interior of the evacuation room main body 10 by the operation of the pump to allow the evacuee to breathe.

As described above, the introduction of the external toxic gas may be perfectly blocked and the air may be supplied for breathing of evacuees, so it is possible to protect the evacuee from the danger of toxic gas and ensure safety of the evacuee as much as possible.

That is, the air storage tank may be installed in the space between the inner and outer panels constituting the bottom member of the evacuation room main body and the third solenoid valve and the pump may be installed in the space between the inner panel and the outer panel constituting the wall of the evacuation room main body such that the air storage tank, the third solenoid valve and the pump can be connected to each other in the space by the pipes, and the discharge side of the pump may be connected to the intake pipe formed of a wire mesh installed on the inner panel to supply the air contained in the air storage tank to the evacuation room main body. Thus, the air supply device for breathing can be prevented from being damaged by flame or falling objects in the event of a fire, so that the air supply device for breathing can normally perform the function thereof in the event of a fire regardless of the danger derived from the flame spreading around the evacuation room or falling objects, thereby ensuring the safety of evacuees as much as possible by continuously supplying air for breathing even when the external air is blocked.

As described above, according to the present invention, the fire evacuation room can be freely installed in the interior or basement of a building so that those who cannot evacuate outside the building in the event of a fire can be safely stayed. In addition, a predetermined differential pressure can be constantly produced in the evacuation space by suitably controlling the amount of air entering the evacuation space and the amount of air leaving the evacuation space. Especially, the present invention can provide a new fire evacuation room capable of blocking toxic gas when the toxic gas is generated while supplying oxygen for breathing, thereby minimizing damage to the persons from the risk of fire. In addition, even if a leak occurs inside the space of the fire evacuation room, it is possible to ensure the safety of evacuees as much as possible by ensuring the air for breathing.

DESCRIPTION OF REFERENCE NUMERALS

10: Evacuation room main body
11: Door
12: Air intake pipe
13: Air discharge pipe
14: Compulsive air discharge fan
15: Lamp
16: Control box
17: Inner panel
18: Outer panel
19: Bulletproof plate
20: Wheel
21: Stopper
22: Air conditioner
23: Opening and closing handle
24: Confirmation window
25: Pipe
26: Evacuation room
27: Shade
28: Shaft pipe
29: Wall heat shield member
30: Silica rope
31: Door heat shield member
32: Sub-air intake pipe
33: First solenoid valve
34: Second solenoid valve
35: Filter device
36: Oxygen generator
37: Sensor
38*a*, 38*b*: Air supply device for breathing
39: Space
40: Air storage tank
41: Pump
42: Third solenoid valve
43: Air intake fan
44: Pipe tee
45: Check valve

The invention claimed is:

1. A fire evacuation room comprising:

an evacuation room main body (10) installed inside a building and having an entrance at a front thereof and an evacuation space at an inside thereof, and an openable door (11) installed in the entrance of the evacuation body main body (10);

an air intake pipe (12) connected to a rear portion of a ceiling of the evacuation room main body (10) to induce air entering the evacuation space;

an air discharge pipe (13) connected to a front portion of the ceiling of the evacuation room main body (10) to induce air exiting the evacuation space;

an air discharge fan installed on an inner rear wall of the evacuation room main body (10) while facing the entrance, and turned ON/OFF in conjunction with an opening/closing operation of the door (11) to block external smoke or heat from entering the evacuation space when the door (11) is opened;

a lamp (15) installed on the ceiling of the evacuation room main body (10); and a control box (16) installed inside the evacuation room main body (10) to supply power and to control electric appliances, and wherein the fire evacuation room further comprises:

a sub-air intake pipe (32) branching from one side of the air intake pipe (12), and an oxygen generator (36) connected to the sub-air intake pipe (32) and configured to receive the air and generate oxygen so that the oxygen supplied from the oxygen generator (36) is supplied into the inside of the evacuation room main body (10).

2. The fire evacuation room of claim 1, wherein the air intake pipe (12) has a diameter relatively larger than a diameter of the air discharge pipe (13), so that an amount of air entering the evacuation space is greater than an amount of air exiting the evacuation space to form a predetermined, constant differential pressure in the evacuation space.

3. The fire evacuation room of claim 1, wherein upper and lower walls, left and right walls, and a rear wall of the evacuation room main body (10) and a plate member of the door (11) are configured as a double panel structure including inner panels (17) and outer panels (18) that define a gap therebetween, and a bulletproof plate (19) woven from aramid fiber is attached to each inner panel (17).

4. The fire evacuation room of claim 1, wherein four wheels (20) including front and rear wheels and left and right wheels and a stopper (21) are installed on a bottom surface of the evacuation room main body (10) as a means for moving and fixing.

5. The fire evacuation room of claim 1, wherein an air conditioner (22) is installed on an inner rear wall of the evacuation room main body (10) to cool air inside the evacuation space upon malfunction of an air intake and discharge system.

6. The fire evacuation room of claim 1, wherein the evacuation room main body (10) is installed on each floor of a high-rise building, and the air intake pipe (12) of each evacuation room main body (10) installed on each floor is connected to a pipe of a ventilation system of the building or a pipe of a blower separately installed in the building, so that air supply to each evacuation room main body (10) is collectively managed in an area inside the building.

7. The fire evacuation room of claim 1, wherein a wall heat shield member (29), which is configured as a band-shaped member having a section of a bent shape, has a silica rope (30) inserted into a groove of the section and minimizes thermal conductivity through a joint portion between walls of the evacuation room main body (10), is fitted into the joint portion between walls of the evacuation room main body (10).

8. The fire evacuation room of claim 1, wherein the door (11) includes a door heat shield member (31), which is installed along edges of four sides of the door (11) to minimize thermal conductivity through the door (11).

9. A fire evacuation room comprising:

an evacuation room main body (10) installed inside a building and having an entrance at a front thereof and an evacuation space at an inside thereof, and an openable door (11) installed in the entrance of the evacuation body main body (10);

an air intake pipe (12) connected to a rear portion of a ceiling of the evacuation room main body (10) to induce air entering the evacuation space;

an air discharge pipe (13) connected to a front portion of the ceiling of the evacuation room main body (10) to induce air exiting the evacuation space;

an air discharge fan installed on an inner rear wall of the evacuation room main body (10) while facing the entrance, and turned ON/OFF in conjunction with an opening/closing operation of a door (11) to block external smoke or heat from entering the evacuation space when the door is opened;

a control box (16) installed inside the evacuation room main body (10) to supply power and to control electric appliances; and an air supply device (38*a*) for breathing, which includes a sub-air intake pipe (32) branching from one side of the air intake pipe (12), first and second solenoid valves (33 and 34) installed on the air intake pipe (12) and the sub-air intake pipe (32), respectively, a filter device (35) installed on the sub-air intake pipe (32) to purify toxic gas in the air, and an oxygen generator (36) connected to the sub-air intake pipe (32) to receive the air and to generate oxygen, wherein the first solenoid valve (33) is turned OFF and the second solenoid valve (34) is turned ON under an output control of the control box (16) receiving a signal of a sensor (37) installed at a side of the air intake pipe (12), and the oxygen generator (36) is operated so that the oxygen supplied from the oxygen generator (36) is supplied into an inside of the evacuation room main body (10).

10. The fire evacuation room of claim 9, wherein the sub-air intake pipe (32), the second solenoid valve (34), the filter device (35), and the oxygen generator (36) are installed in a space portion (39) defined inside the walls of the evacuation room main body (10).

11. The fire evacuation room of claim 9, wherein the air intake pipe (12) has a diameter relatively larger than a diameter of the air discharge pipe (13), so that an amount of air entering the evacuation space is greater than an amount of air exiting the evacuation space to form a predetermined, constant differential pressure in the evacuation space.

12. The fire evacuation room of claim 9, wherein upper and lower walls, left and right walls, and a rear wall of the evacuation room main body (10) and a plate member of the door (11) are configured as a double panel structure including inner panels (17) and outer panels (18) that define a gap therebetween, and a bulletproof plate (19) woven from aramid fiber is attached to each inner panel (17).

13. The fire evacuation room of claim 9, wherein an air conditioner (22) is installed on an inner rear wall of the evacuation room main body (10) to cool air inside the evacuation space upon malfunction of an air intake and discharge system.

14. The fire evacuation room of claim 9, wherein the evacuation room main body (10) is installed on each floor of a high-rise building, and the air intake pipe (12) of each evacuation room main body (10) installed on each floor is connected to a pipe of a ventilation system of the building or a pipe of a blower separately installed in the building, so that air supply to each evacuation room main body (10) is collectively managed in an area inside the building.

15. The fire evacuation room of claim 9, wherein a wall heat shield member (29), which is configured as a band-shaped member having a section of a bent shape, has a silica rope (30) inserted into a groove of the section and minimizes thermal conductivity through a joint portion between walls of the evacuation room main body (10), is fitted into the joint portion between walls of the evacuation room main body (10).

16. The fire evacuation room of claim 9, wherein the door (11) includes a door heat shield member (31) that is installed along edges of four sides of the door (11) to minimize thermal conductivity through the door (11).

17. A fire evacuation room comprising:

an evacuation room main body (10) installed inside a building and having an entrance at a front thereof and an evacuation space at an inside thereof, and an openable door (11) installed in the entrance of the evacuation body main body (10);

an air intake pipe (12) connected to a rear portion of a ceiling of the evacuation room main body (10) to induce air entering the evacuation space;

an air discharge pipe (13) connected to a front portion of the ceiling of the evacuation room main body (10) to induce air exiting the evacuation space;

an air discharge fan installed on an inner rear wall of the evacuation room main body (10) while facing the entrance, and turned ON/OFF in conjunction with an opening/closing operation of a door (11) to block external smoke or heat from entering the evacuation space when the door is opened;

a control box (16) installed inside the evacuation room main body (10) to supply power and to control electric appliances; and an air supply device (38*b*) for breathing, which includes a first solenoid valve (33) installed on the air intake pipe (12), an air storage tank (40) installed at an internal space of a bottom member of the evacuation room main body (10), a pump (41) installed at a discharge port of the air storage tank (40) and a third solenoid valve (42), wherein the first solenoid valve (33) is turned OFF and the third solenoid valve (42) is turned ON under an output control of the control box (16) receiving a signal of a sensor (37) installed on a side of the air intake pipe (12), and the pump (41) is operated so that the air filled in the air storage tank (40) is supplied into an inside of the evacuation room main body (10).

18. The fire evacuation room of claim 17, wherein the air intake pipe (12) has a diameter relatively larger than a diameter of the air discharge pipe (13), so that an amount of air entering the evacuation space is greater than an amount of air exiting the evacuation space to form a predetermined, constant differential pressure in the evacuation space.

19. The fire evacuation room of claim 17, wherein upper and lower walls, left and right walls, and a rear wall of the evacuation room main body (10) and a plate member of the door (11) are configured as a double panel structure including inner panels (17) and outer panels (18) that define a gap therebetween, and a bulletproof plate (19) woven from aramid fiber is attached to each inner panel (17).

20. The fire evacuation room of claim 17, wherein an air conditioner (22) is installed on an inner rear wall of the evacuation room main body (10) to cool air inside the evacuation space upon malfunction of an air intake and discharge system.

21. The fire evacuation room of claim 17, wherein the evacuation room main body (10) is installed on each floor of a high-rise building, and the air intake pipe (12) of each evacuation room main body (10) installed on each floor is connected to a pipe of a ventilation system of the building or a pipe of a blower separately installed in the building, so that air supply to each evacuation room main body (10) is collectively managed in an area inside the building.

22. The fire evacuation room of claim 17, wherein a wall heat shield member (29), which is configured as a band-shaped member having a section of a bent shape, has a silica rope (30) inserted into a groove of the section and minimizes thermal conductivity through a joint portion between walls of the evacuation room main body (10), is fitted into the joint portion between walls of the evacuation room main body (10).

23. The fire evacuation room of claim 17, wherein the door (11) includes a door heat shield member (31) that is installed along edges of four sides of the door (11) to minimize thermal conductivity through the door (11).

* * * * *